US007050980B2

(12) United States Patent
Wang et al.

(10) Patent No.: US 7,050,980 B2
(45) Date of Patent: May 23, 2006

(54) SYSTEM AND METHOD FOR COMPRESSED DOMAIN BEAT DETECTION IN AUDIO BITSTREAMS

(75) Inventors: Ye Wang, Tampere (FI); Miikka Vilermo, Tampere (FI)

(73) Assignee: Nokia Corp., Espoo (FI)

( * ) Notice: Subject to any disclaimer, the term of this patent is extended or adjusted under 35 U.S.C. 154(b) by 629 days.

(21) Appl. No.: 09/966,482

(22) Filed: Sep. 28, 2001

(65) Prior Publication Data

US 2002/0178012 A1 Nov. 28, 2002

Related U.S. Application Data

(63) Continuation-in-part of application No. 09/770,113, filed on Jan. 24, 2001.

(51) Int. Cl.
*G10L 21/04* (2006.01)

(52) U.S. Cl. ..... 704/503; 704/200.1; 704/204; 381/56; 434/262; 382/240; 382/107

(58) Field of Classification Search ..... 704/200.1, 704/204, 503; 381/56; 434/262; 382/107, 382/240; 600/437; 323/107
See application file for complete search history.

(56) References Cited

U.S. PATENT DOCUMENTS 5,040,217 A 8/1991 Brandenburg et al.
5,148,487 A 9/1992 Nagai et al.
5,256,832 A 10/1993 Miyake
5,285,498 A 2/1994 Johnston
5,361,278 A 11/1994 Vaupel et al.
5,394,473 A 2/1995 Davidson
5,481,614 A 1/1996 Johnston
5,579,430 A 11/1996 Grill et al.
5,636,276 A 6/1997 Brugger
5,841,979 A 11/1998 Schulhof et al.
5,852,805 A 12/1998 Hiratsuka et al.
5,875,257 A * 2/1999 Marrin et al. ..... 382/107
5,928,330 A 7/1999 Goetz et al.

(Continued)

FOREIGN PATENT DOCUMENTS

DE 197 36 669 10/1998

(Continued)

OTHER PUBLICATIONS

Bosse, Modified Discrete Cosine Tranform (MDCT), Mar. 7, 1998, available at http://ccrma-www.standford.edu/-bosse/prol/node27.html.

(Continued)

*Primary Examiner*—W. R. Young
*Assistant Examiner*—Jakieda R Jackson
(74) *Attorney, Agent, or Firm*—Banner & Witcoff, Ltd.

(57) ABSTRACT

A system and method for detecting beats in a compressed audio domain is disclosed where a beat detector functions as part of an error concealment system in an audio decoding section used in audio information transfer and audio down-load-streaming system terminal devices such as mobile phones. The beat detector includes a MDCT coefficient extractor, a band feature value analyzer, a confidence score calculator; and a converging and storage unit. The method provides beat detection by means of beat information obtained using both MDCT coefficients as well as window-switching information. A baseline beat position is determined using MDCT coefficients obtained from the audio bitstream which also provides a window-switching pattern. A window-switching beat position is compared with the baseline beat position and, if a predetermined condition is satisfied, the window-switching beat position is validated as a detected beat.

58 Claims, 13 Drawing Sheets

U.S. PATENT DOCUMENTS

| | | | | |
|---|---|---|---|---|
| 6,005,658 | A * | 12/1999 | Kaluza et al. | 356/39 |
| 6,064,954 | A | 5/2000 | Cohen et al. | |
| 6,115,689 | A | 9/2000 | Malvar | |
| 6,125,348 | A | 9/2000 | Levine | |
| 6,141,637 | A * | 10/2000 | Kondo | 704/204 |
| 6,175,632 | B1 * | 1/2001 | Marx | 381/56 |
| 6,199,039 | B1 | 3/2001 | Chen et al. | |
| 6,287,258 | B1 * | 9/2001 | Phillips | 600/437 |
| 6,305,943 | B1 * | 10/2001 | Pougatchev et al. | 434/262 |
| 6,453,282 | B1 | 9/2002 | Hilpert et al. | |
| 6,477,150 | B1 | 11/2002 | Maggenti et al. | |
| 6,597,961 | B1 | 7/2003 | Cooke | |
| 6,738,524 | B1 * | 5/2004 | de Queiroz | 382/240 |
| 6,787,689 | B1 * | 9/2004 | Chen | 84/600 |
| 6,807,526 | B1 * | 10/2004 | Touimi et al. | 704/222 |

FOREIGN PATENT DOCUMENTS

| | | |
|---|---|---|
| EP | 0 703 712 A2 | 3/1996 |
| EP | 0 718 982 A2 | 6/1996 |
| EP | 1 207 519 | 5/2002 |
| WO | WO 93/26099 | 6/1993 |
| WO | 98/13965 | 4/1998 |

OTHER PUBLICATIONS

Fraunhofer, MPEG Audio Layer-3, available at http://www.iis.fhg.de/amm/techinf/layer3/index.html.

WCOMAN—the wideband 'radio pipe' for 3G services, Sep. 17, 1999, available at http://www.ericsson.com/wireless/productsys/gsm/subpages/umts_and_3g/wcdman.shtml.

GSM Frequently Asked Questions, Oct. 23, 2000, available at http://www.gsmworld.com/technology/faw.html.

Perkins, Hodson, Options for Repair of Streaming Media, Network Working Group RFC 2354, The Internet Society, Jun. 1998.

Goto & Hayamizu, A Real-time Music Scene Description System: Detecting Melody and Bass Lines in Audio Signals, Aug. 1999. Working Notes of the UCAI-99 Workshop on Computational Auditory Scene Analysis, p. 31-40.

Y. Wang et al., "On The Relationship Between MDCT, SDFT And DFT", WCC 2000—ISCP 2000, Aug. 21-25, 2000, pp. 44-47.

Y. Wang et al., "A Compressed Domain Beat Detector Using MP3 Audio Bitstreams", Proceedings Of The ACM International Multimedia Conference And Exhibition 2001, ACM Multimedia 2001 Workshops, Sep. 30, 2001, pp. 194-202.

Y. Wang, "A Beat-Pattern based Error Concealment Scheme for Music Delivery with Burst Packet Loss", 2001 IEEE International Conference on Multimedia and Expo, ICME 2001, Aug. 22-25, 2001, pp. 73-76.

Herre, et al, Evaluation of Concealment Techniques for compressed Digital Audio, Audtio Engineering Society Preprint, Mar. 16-19, 1993, Preprint 3460 (A1-4), Erlangen, Germany.

Bolot et al, Analysis of Audio Packet Loss in the Internet, Proc. Of 5th Int. Workshop on Network and Operating System Support for Digital, Audio and Video, pp. 163-174, Durham, Apr. 1995.

International Standard ISO/IEC, Information Technology—Coding of Moving Pictures and Associated Audio for Digital Storage Media at up to About 1.5 Mbit/s—Part 3, Audio Technical Corrigendum 1, Published Apr. 15, 1996.

Stenger et al, A New Error Concealment Technique for Audio Transmission with Packet Loss, Telecommunications Institute, University of Erlangen-Nuremberg, Cauerstrasse 7, 91058 Erlangen, Germany, Eusipco 1996.

McKinley et al, Experimental Evaluation of Forward Error Correction on Multicast Audio Streams in Wireless LANs, Department of Computer Science and Engineering, Michigan State University, East Lansing, Michigan 48824, pp. 1-10, Copyright 2000 ACM.

Nishihara et al, A Practical Query-By-Humming System for a Large Music Database, NTT Laboratories, 1—1 Hikarinooka, Yokosuka-shi, Kanagawa, 239-0847, Japan pp. 1-38.

Wang, Y., Vilermo, M., Isherwood, D. "The Impact of the Relationship Between MDCT and DFT on Audio Compression: A Step Towards Solvign the Mismatch", the First IEEE Pacific-Rim Conference on Multimedia (IEEE-PCM2000), Dec. 13-15, 2000, Sydney, Australia, pp. 130-138.

Perkins, C., Hodson, O., Hardman, V., "A Survey of Packet-loss Recovery Techniques for Streaming Audio," IEEE Network, Sep./Oct. 1998.

ETSI Rec. GSM 6.11, "Substitution and Muting of Lost Frames for Full Rate Speech Signals," 1992.

Goodman, O.J. et al., "Waveform Substitution Techniques for Recovering Missing Speech Segments in Packet Voice Communications," IEEE Trans. Acoustics, Speech, and Sig. Processing, vol. ASSP-34, No. 6, Dec. 1986, pp. 1440-1448.

Goto Masataka, et al., "Beat Tracking based on Multiple-agent Architecture-A Real-time Beat Tracking System for Audio Signals," pp. 103-110, 1996, no date.

Scheirer, Eric D., "Tempo and Beat Analysis of Acoustics Music Signals", J. Acoust. Soc. Am. 103 (1), Jan. 1998, pp. 588-601, no date.

Wasem, O.J. et al, "The Effects of Waveform Substitution on the Quality of PCM Packet Communications," IEEE Trans. Acoustics, Speech, and Sig. Processing, vol. 36 No. 3, Mar. 1988, pp. 342-348, no date found.

Sanneck, H. et al., "A New Technique for Audio Packet Loss Concealment," IEEE Global Internet 1996, Dec. 1996 pp. 48-52, no date found.

Chen, Y.L. Chen, B.S., "Model-based Multirate Representation of Speech Signals and its Application to Recovery of Missing Speech Packets," IEEE Trans. Speech and Audio Processing, vol. 15, No. 3, May 1997, pp. 220-231, no date found.

Davis Pan, "A Tutorial on MPEG/Audio Compression," IEEE Multimedia, pp. 60-74, (Summer 1995).

A Free Audio Compression Format?, http://www.sufaco.org/mp3/free.html>.Sep. 24, 2001.

Yajnik, M. et al., "Packet Loss Correlation in the Mbone Multicast Network", Proc. IEEE Global Internet Conference, Nov. 1996.

Jayant, N.S., et al., "Effects of Packet Losses in Waveform Coded Speech and Improvements due to an Odd-Even Sample Interpolation Procedure", IEEE Trans. Commun., vol. COM-29, No. 2, Feb. 1981, pp. 101-109.

Carle, G., et al., "Survey of Error Recovery Techniques for IP-Based Audio-Visual Multicast Applications", IEEE Network, Nov./Dec. 1997.

Herre, J. et al., "Extending the MPEG-4AAC Codec by Perceptual Noise Substitution, 104" AES Convention, Amsterdam 1998, preprint 4720.

Malvar, "Biorthogonal and Nonuniform Lapped Transforms or Transform Coding with Reduced Blocking and Ringing Artifacts," IEEE Transactions on Signal Processing, col. 46, Issue 4, Apr. 1998, pp. 1043-1053.

* cited by examiner

SYSTEM AND METHOD FOR COMPRESSED DOMAIN BEAT DETECTION IN AUDIO BITSTREAMS

CROSS-REFERENCE TO RELATED APPLICATION

This application is a continuation-in-part of commonly-assigned U.S. patent application Ser. No. 09/770,113 entitled "System and Method for Concealment of Data Loss in Digital Audio Transmission" filed Jan. 24, 2001 incorporated herein in its entirety by reference.

FIELD OF THE INVENTION

This invention relates to the concealment of transmission errors occurring in digital audio streaming applications and, in particular, to a system and method for beat detection in audio bitstreams.

BACKGROUND OF THE INVENTION

The transmission of audio signals in compressed digital packet formats, such as MP3, has revolutionized the process of music distribution. Recent developments in this field have made possible the reception of streaming digital audio with handheld network communication devices, for example. However, with the increase in network traffic, there is often a loss of audio packets because of either congestion or excessive delay in the packet network, such as may occur in a best-effort based IP network.

Under severe conditions, for example, errors resulting from burst packet loss may occur which are beyond the capability of a conventional channel-coding correction method, particularly in wireless networks such as GSM, WCDMA or BLUETOOTH. Under such conditions, sound quality may be improved by the application of an error-concealment algorithm. Error concealment is an important process used to improve the quality of service (QoS) when a compressed audio bitstream is transmitted over an error-prone channel, such as found in mobile network communications and in digital audio broadcasts.

Perceptual audio codecs, such as MPEG-1 Layer III Audio Coding (MP3), as specified in the International Standard ISO/IEC 11172-3 entitled "Information technology of moving pictures and associated audio for digital storage media at up to about 1,5 Mbits/s—Part 3: Audio," and MPEG-2/4 Advanced Audio Coding (AAC), use frame-wise compression of audio signals, the resulting compressed bitstream then being transmitted over the audio packet network. With rapid deployment of audio compression technologies, more and more audio content is stored and transmitted in compressed formats. The transmission of audio signals in compressed digital packet formats, such as MP3, has revolutionized the process of music distribution.

A critical feature of an error concealment method is the detection of beats so that replacement information can be provided for missing data. Beat detection or tracking is an important initial step in computer processing of music and is useful in various multimedia applications, such as automatic classification of music, content-based retrieval, and audio track analysis in video. Systems for beat detection or tracking can be classified according to the input data type, that is, systems for musical score information such as MIDI signals, and systems for real-time applications.

Beat detection, as used herein, refers to the detection of physical beats, that is, acoustic features exhibiting a higher level of energy, or peak, in comparison to the adjacent audio stream. Thus, a 'beat' would include a drum beat, but would not include a perceptual musical beat, perhaps recognizable by a human listener, but which produces little or no sound.

However, most conventional beat detection or tracking systems function in a pulse-code modulated (PCM) domain. They are computationally intensive and not suitable for use with compressed domain bitstreams such as an MP3 bitstream, which has gained popularity not only in the Internet world, but also in consumer products. A compressed domain application may, for example, perform a real-time task involving beat-pattern based error concealment for streaming music over error-prone channels having burst packet losses.

What is needed is an audio data decoding and error concealment system and method which provides for beat detection in the compressed domain.

SUMMARY OF THE INVENTION

The present invention discloses a beat detector for use in a compressed audio domain, where the beat detector functions as part of an error concealment system in an audio decoding section used in audio information transfer and audio download-streaming system terminal devices such as mobile phones. The beat detector includes a modified discrete cosine transform coefficient extractor, for obtaining transform coefficients, a band feature value analyzer for analyzing a feature value for a related band, a confidence score calculator; and a converging and storage unit for combining two or more of the analyzed band feature values. The method disclosed provides beat detection by means of beat information obtained using both modified discrete cosine transform (MDCT) coefficients as well as window-switching information. A baseline beat position is determined using modified discrete cosine transform coefficients obtained from the audio bitstream which also provides a window-switching pattern. A window-switching beat position is found using the window-switching pattern and is compared with the baseline beat position. If a predetermined condition is satisfied, the window-switching beat position is validated as a detected beat.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
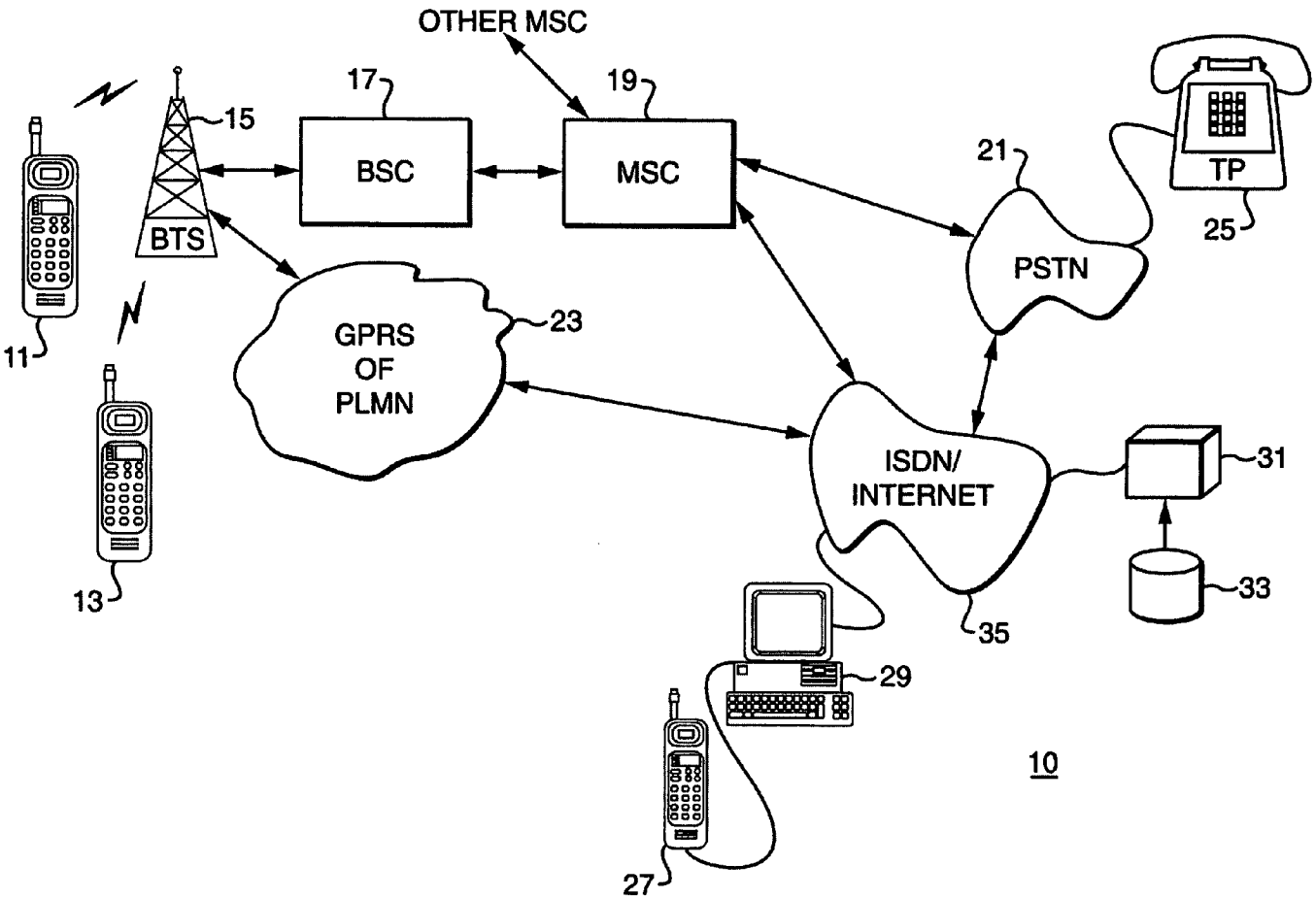
FIG. 1 (PRIOR ART)
FIG. 1 is a general block diagram of an audio information transfer and streaming system including mobile telephone terminals.

FIG. 1 presents an audio information transfer and audio download and/or streaming system 10 comprising terminals such as mobile phones 11 and 13, a base transceiver station 15, a base station controller 17, a mobile switching center 19, telecommunication networks 21 and 23, and user terminals 25 and 27, interconnected either directly or over a terminal device, such as a computer 29. In addition, there may be provided a server unit 31 which includes a central processing unit, memory (not shown), and a database 33, as well as a connection to a telecommunication network 35, such as the Internet, an ISDN network, or any other telecommunication network that is in connection either directly or indirectly to the network into which the mobile phone 11 is capable of being connected, either wirelessly or via a wired line connection. In a typical audio data transfer system, the mobile stations and the server are point-to-point connected.

Figure 2:
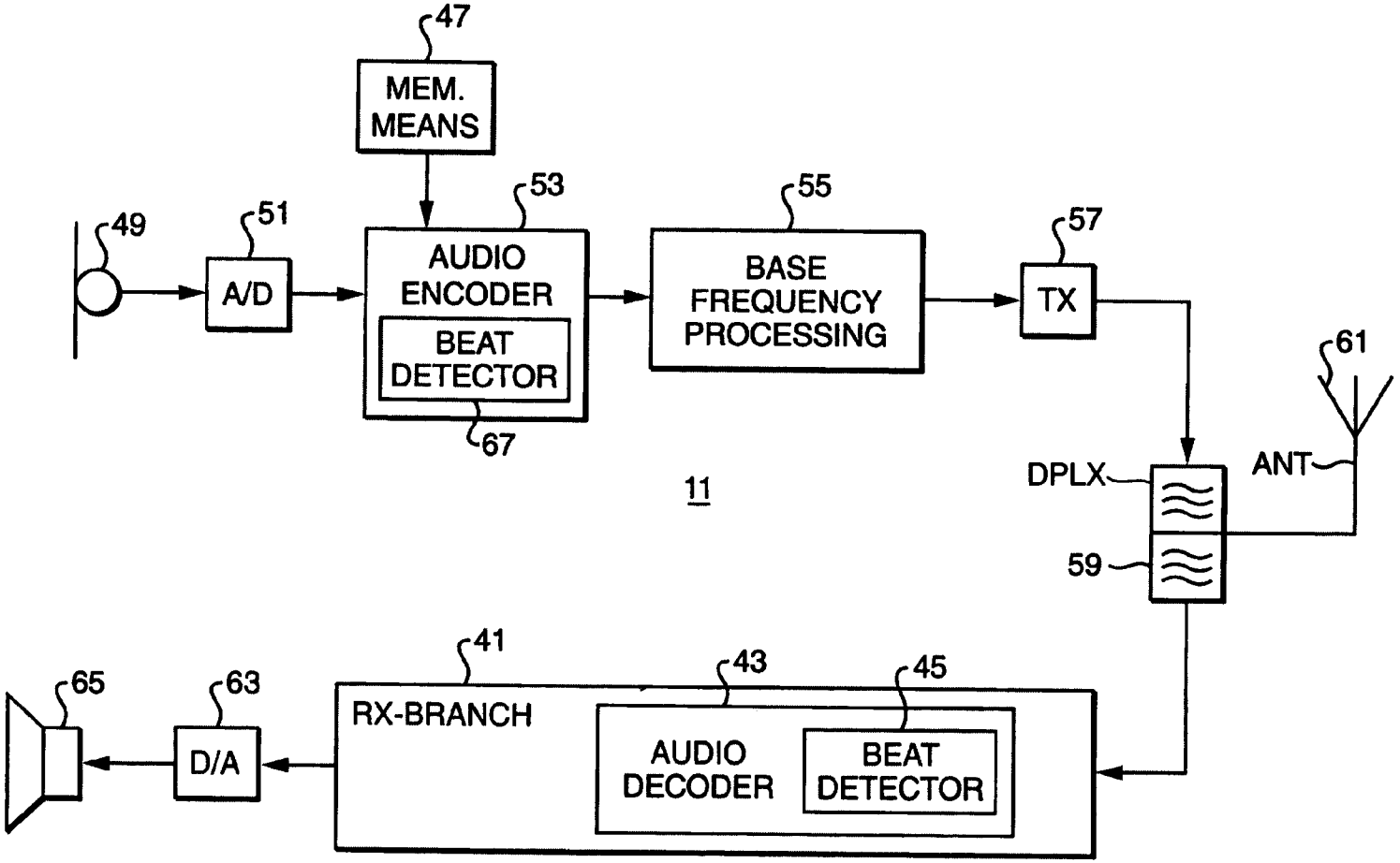
FIG. 2 is a functional block diagram of a mobile telephone including beat detectors in receiver and audio decoders for use in the system of FIG. 1.

FIG. 2 presents as a block diagram the structure of the mobile phone 11 in which a receiver section 41 includes a decoder beat detector control block 45 included in an audio decoder 43. The receiver section 41 utilizes compression-encoded audio transmission protocol when receiving audio transmissions. The decoder beat detector control block 45 is used for beat detection when an incoming audio bitstream includes no beat detection data in the bitstream as side information. A received audio signal is obtained from a memory 47 where the audio signal has been stored digitally. Alternatively, audio data may be obtained from a microphone 49 and sampled via an A/D converter 51.

For audio transmission, the audio data is encoded in an audio encoder 53, where the encoding may include as side information beat data provided by an encoder beat detector control block 67. It can be appreciated by one skilled in the relevant art that beat information provided by the encoder beat detector control block 67 is more reliable than beat information provided by the decoder beat detector control block 45 because there is no packet loss at the audio encoder 53. Accordingly, in a preferred embodiment, the audio encoder 53 includes the encoder beat detector control block 67, and the decoder beat detector control block 45 can be provided as an optional component in the audio decoder 41. Thus, during operation of the receiver section 41, the audio decoder 43 checks the side information for beat information. If beat information is present, the decoder beat detector control block 45 is not used for beat detection. However, if there is no beat information provided in the side information, beat detection is performed by the decoder beat detector control block 45, as described in greater detail below. Because of a possible packet loss, beat detection can also be performed in both the encoder and the decoder sides. In this case, the decoder performs only the window-type beat detection. Thus the computational complexity of the decoder is greatly reduced.

After encoding, the processing of the base frequency signal is performed in block 55. The channel-coded signal is converted to radio frequency and transmitted from a transmitter 57 through a duplex filter 59 and an antenna 61. At the receiver section 41, the audio data is subjected to the decoding functions including beat detection, as is known in the relevant art. The recorded audio data is directed through a D/A converter 63 to a loudspeaker 65 for reproduction.

The user of the mobile phone 11 may select audio data for downloading, such as a short interval of music or a short video with audio music. In the 'select request' from the user, the terminal address is known to the server unit 31 as well as the detailed information of the requested audio data (or multimedia data) in such detail that the requested information can be downloaded. The server unit 31 then downloads the requested information to another connection end. If connectionless protocols are used between the mobile phone 11 and the server unit 31, the requested information is transferred by using a connectionless connection in such a way that recipient identification of the mobile phone 11 is attached to the sent information. When the mobile phone 11 receives the audio data as requested, it can be streamed and played in the loudspeaker 65 using an error concealment method which utilizes a method of beat detection such as disclosed herein.

Figure 3:
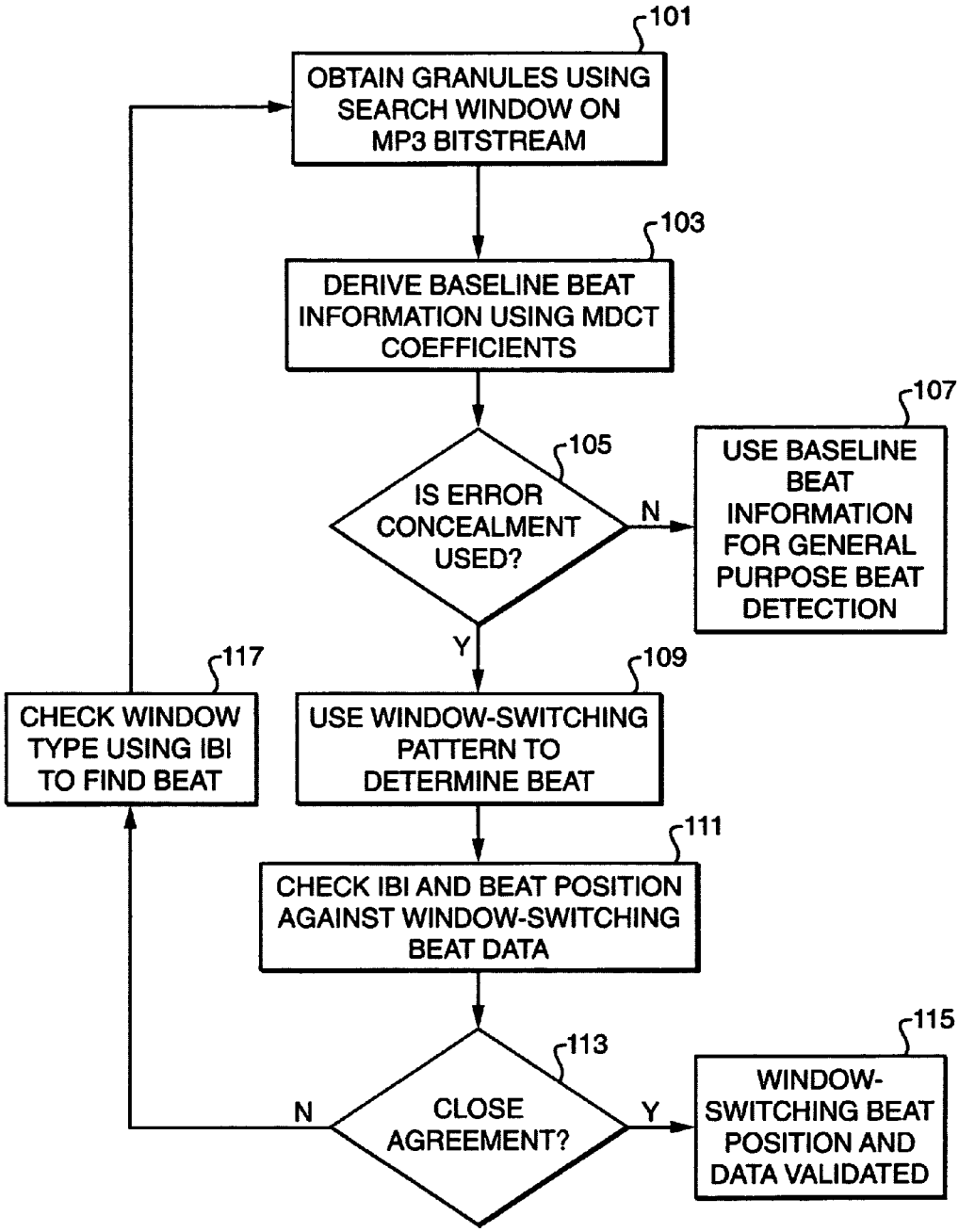
FIG. 3 is a flow diagram describing a beat detection process that can be used with the mobile telephone of FIG. 2.

FIG. 3 is a flow diagram describing a preferred embodiment of a beat detection process which can be used with encoder beat detector control block 67 and the encoder beat detector control block 45 shown in FIG. 2. A partially-decoded MP3 audio bitstream is received, at step 101 in FIG. 3, and several granules of MP3 data are obtained using a search window. The number of granules obtained is a function of the size of the search window (see equation (4) below). Baseline beat information is derived from modified discrete cosine transform (MDCT) coefficients obtained from the MP3 granules, at step 103, as described in greater detail below. The baseline information provides beat 'candidates' for further evaluation. In an alternative embodiment, the beat candidate obtained at this point can be utilized in a general purpose beat detection operation, at step 107.

If error concealment is to be performed, as determined in decision block 105, a corresponding window-switching pattern is used to determine a window-switching beat location, at step 109. A degree of confidence in the baseline beat determination obtained in step 103 is subsequently established by checking the baseline beat position and a baseline beat-related inter-beat interval against the beat information derived by evaluating the window-switching pattern, at step 111, as described in greater detail below. If the two beat detection methods are in close agreement, at decision block 113, the window-switching beat information is used in the beat detector control block 45 to validate the beat position, at step 115. Otherwise, the process proceeds to step 117 where the window type is checked at the predicted beat position using the inter-beat interval. The beat position is then determined by the window-switching beat information and the process returns to step 101 where the search window 'hops,' or shifts, to the next group of MP3 granules as is well-known in the relevant art.

Figure 4:
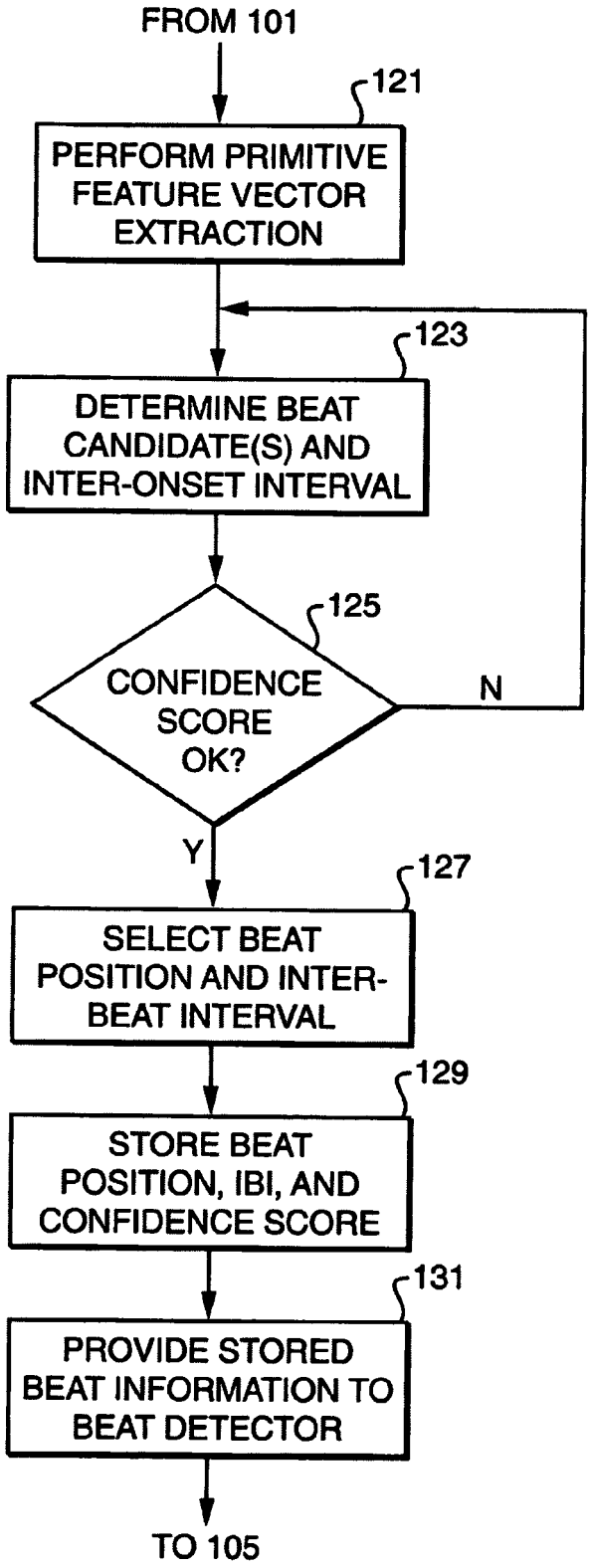
FIG. 4 is a flow diagram showing in greater detail a baseline beat information derivation procedure used in the flow diagram of FIG. 3.
Figure 5:
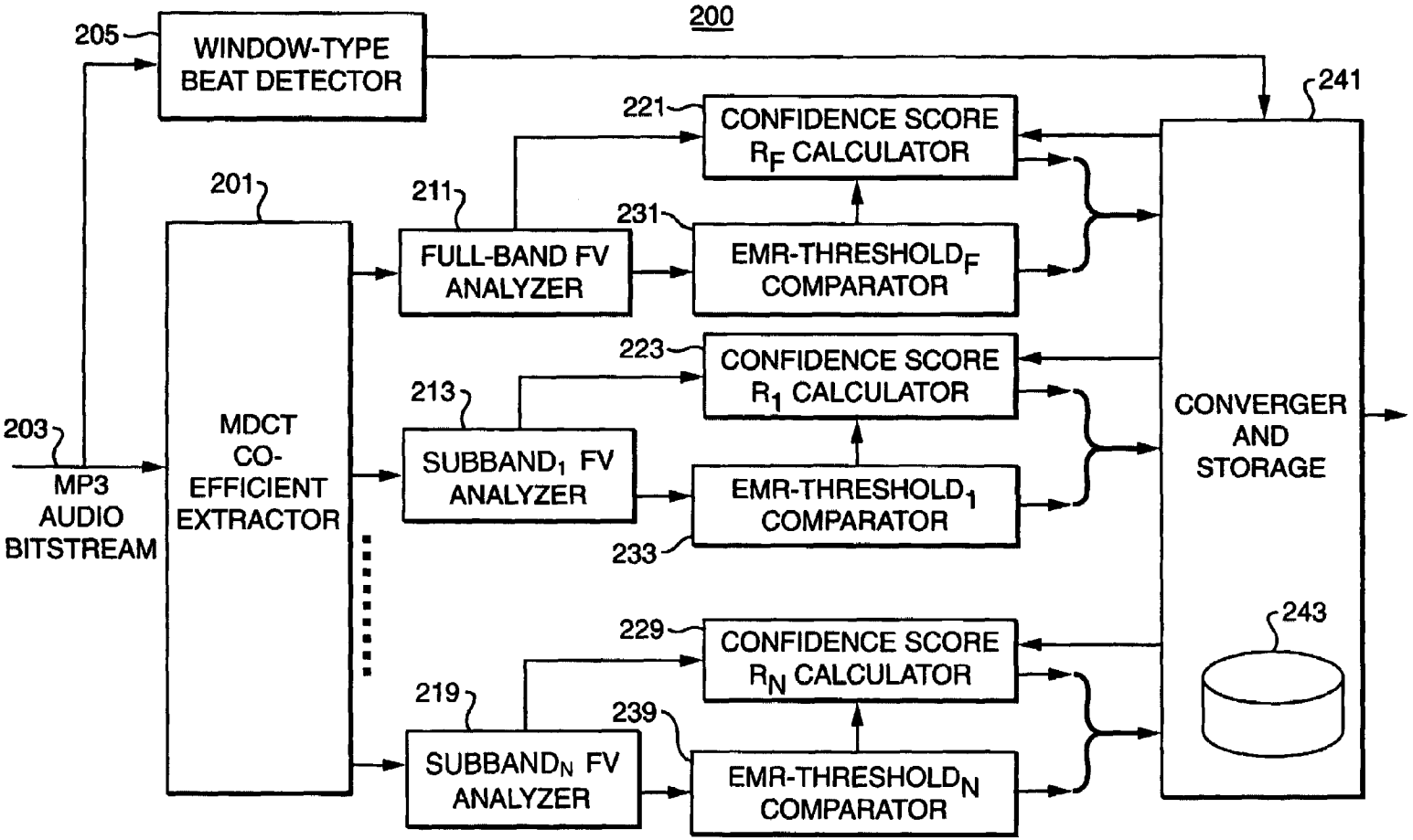
FIG. 5 is a functional block diagram of a compressed domain beat detector such as can be used in the mobile telephone of FIG. 2.

FIG. 4 is flow diagram showing in greater detail the process of deriving baseline information using modified DCT coefficients as denoted by step 103 of FIG. 3, above. The process of deriving baseline information can be conducted using a compressed domain beat detector 200, shown in FIG. 5. The beat detector 200 includes an MDCT coefficient extractor 201 for receiving an incoming MP3 audio bitstream 203. The MP3 audio bitstream 203 is also provided to a window-type beat detector 205, as described in greater detail below. The MDCT coefficient extractor 201 functions to provide coefficients in full-band as well as coefficients segregated by subband for use in deriving separate subband energy values. In the configuration shown, the MDCT coefficient extractor 201 produces some of the baseline information by outputting a full-band set of MDCT coefficients to a full-band feature vector (FV) analyzer 211.

The beat detector 200 functions by utilizing information provided by a plurality of subbands, here denoted as a first subband through an N subband, in addition to the information provided by the full-band set of coefficients. The MDCT coefficient extractor 201 further operates to output a first subband set of MDCT coefficients to a first subband feature vector analyzer 213, a second subband set of MDCT coefficients to a second subband feature vector analyzer (not shown) and so on to output an $N^{th}$ subband set of MDCT coefficients to an $N^{th}$ subband feature vector analyzer 219.

The feature vector analyzers 211 through 219 each extract a feature value (FV) for use in beat determination, in step 121. As explained in greater detail below, the feature value may take the form of a primitive band energy value, an element-to-mean ratio (EMR) of the band energy, or a differential band energy value. The feature vector can be directly calculated from decoded MDCT coefficients, using equation (6) below. In the disclosed method, feature vectors are extracted from the full-band and individual subbands separately to avoid possible loss of information. In a preferred embodiment, the frequency boundaries of the new subbands are specified in Table I for long windows and in Table II for short windows for a sampling frequency of 44.1 kHz. For alternative embodiments using other sampling frequencies, the subbands can be defined in a similar manner as can be appreciated by one skilled in the relevent art.

TABLE I

Subband division for long windows

| Sub-band | Frequency interval (Hz) | Index of MDCT coefficients | Scale factor band index |
|---|---|---|---|
| 1 | 0–459 | 0–11 | 0–2 |
| 2 | 460–918 | 12–23 | 3–5 |
| 3 | 919–1337 | 24–35 | 6–7 |
| 4 | 1338–3404 | 36–89 | 8–12 |
| 5 | 3405–7462 | 90–195 | 13–16 |
| 6 | 7463–22050 | 196–575 | 17–21 |

TABLE II

Subband division for short windows

| Sub-band | Frequency interval (Hz) | Index of MDCT coefficients | Scale factor band index |
|---|---|---|---|
| 1 | 0–459 | 0–3 | 0 |
| 2 | 460–918 | 4–7 | 1 |
| 3 | 919–1337 | 8–11 | 2 |

TABLE II-continued

Subband division for short windows

| Sub-band | Frequency interval (Hz) | Index of MDCT coefficients | Scale factor band index |
|---|---|---|---|
| 4 | 1338–3404 | 12–29 | 3–5 |
| 5 | 3405–7465 | 30–65 | 6–8 |
| 6 | 7463–22050 | 66–191 | 9–12 |

The process of feature extraction uses the full-band feature vector analyzer 211, as described in greater detail below, where the full-band extraction results are output to a full-band confidence score calculator 221. In a preferred embodiment, the full-band extraction results are also output to a full-band EMR threshold comparator 231 for an improved determination of beat position. The feature vector extraction process also includes using the first subband feature vector analyzer 213 through the $N^{th}$ subband feature vector analyzer 219 to output subband extraction to a first subband confidence score calculator 223 through an $N^{th}$ subband confidence score calculator 229 respectively. In a preferred embodiment, the subband extraction results are also output to a first subband EMR threshold comparator 233 through an $N^{th}$ subband EMR threshold comparator 239 respectively.

A beat candidate selection process is performed in two stages. In the first stage, beat candidates are selected in individual bands based on a process identifying feature values which exceed a predefined threshold in a given search window, as explained in greater detail below. Within each search window the number of candidates in each band is either one or zero. If there are one or more valid candidates selected from individual bands, they are then clustered and converged to a single candidate according to certain criteria.

Figure 10:
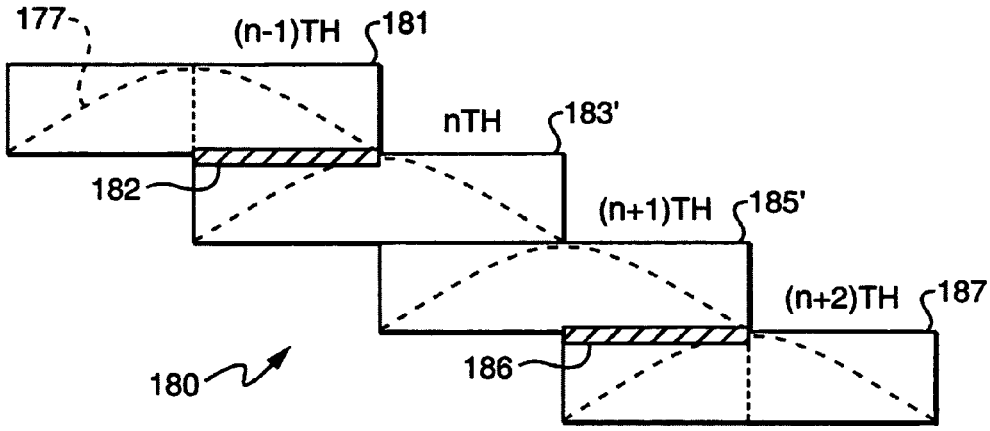
FIG. 10 is an example of error concealment in accordance with the disclosed method.

A valid candidate in a particular band is defined as an 'onset,' and a number of previous inter-onset interval (IOI) values are stored in a FIFO buffer for beat prediction in each band, such as a circular FIFO buffer 350 in FIG. 10 below. The median of the inter-onset interval vector is used to calculate the confidence scores of beat candidates in individual bands. The inter-onset interval vector size is a tunable parameter for adjusting the responsiveness of the beat detector. If the inter-onset interval vector size is kept small, the beat detector is quick to adapt to a changed tempo, but at the cost of potential instability. If the inter-onset interval vector size is kept large, it becomes slow to adapt to a changed tempo, but it can tackle more difficult situations better. In a preferred embodiment, a FIFO buffer of size nine is used. As the inter-onset interval rather than the final inter-beat interval is stored in the buffer, the tempo change is registered in the FIFO buffer. However, the search window size is updated to follow the new tempo only after four inter-onset intervals, or about two to three seconds in duration.

In the second stage, the beat candidates are checked for an acceptable confidence score, at decision block 125, using outputs from the confidence score calculators 221 through 229. A confidence score is calculated for each beat candidate from an individual band to score the reliability of the beat candidate (see equation (1) below). A final confidence score is calculated from the individual confidence scores, and is used to determine whether a converged candidate is a beat. If the confidence scores fall below a predetermined confidence threshold, the process returns to step 123 where a new set of beat candidates and inter-onset intervals are found. Otherwise, if the confidence score for a particular beat position is above the confidence threshold, the onset position is selected as the correct beat location, at step 127, and the associated inter-onset interval is accepted as the inter-beat interval. The beat position, inter-beat interval, and confidence score are stored for subsequent use.

An inter-onset interval histogram, generated from empirical beat data, can be used to select the most appropriate threshold, which can then be used to select beat candidates. A set of previous inter-onset intervals in each band is stored in the FIFO buffer for computing the candidate's confidence score of that band. Alternatively, a statistical model can be used with a median in the FIFO buffer to predict the position of the next beat.

The plurality of beat candidates together with their confidence scores from all the bands are converged in a convergence and storage module 241. The beat candidate having the greatest confidence score within a search window is selected as a center point. If beat candidates from other bands are close to the selected center point, for example, within four MP3 granules, the individual beat candidates are clustered. The confidence of a cluster is the maximum confidence of its members, and the location of the cluster is the rounded mean of all locations of its members. Other candidates are ignored and one candidate is accepted as a beat when its final confidence score is above a constant threshold. The beat position, the inter-beat interval, and the overall confidence score (see equation (3) below) are sent either to the audio decoder 43 or to the audio encoder 53 after checking with the window switching pattern provided by the window-type beat detector 205, and the beat detection process proceeds to step 105.

The confidence score for an individual beat candidate can be calculated in accordance with the following formula:

$$R_i = \max_{k=1,2,3}\left[\frac{median(\overline{IOI})}{median(\overline{IOI}) + \left|median(\overline{IOI}) - \frac{(I_i - I_{\text{last_beat}})}{k}\right|}\right]\cdot f(E_i) \tag{1}$$

for i=F,1, . . . , N, where 1 through N are the subband indicies and F is the index of the full-band. The value of the parameter k is '1' unless the current inter-onset interval is two or three times longer than the predicted value due to a missed candidate, in which case the value of the parameter k is set to '2' or '3' accordingly. The term $\overline{IOI}$ is a vector of previous inter-onset intervals and the size of $\overline{IOI}$ is an odd number. The term median ($\overline{IOI}$) is used as a prediction of the current beat where the parameter i is the current beat candidate index, and the term $I_i$ is the MP3 granule index of the current beat candidate. $I_{last_beat}$ is the MP3 granule index of the previous beat. The term $f(E_i)$ is introduced to discard candidates having low energy levels.

$$f(E_i) = \begin{cases} 0, & E_i < threshold_i \\ 1, & E_i \geq threshold_i \end{cases} \tag{2}$$

where $E_i$ is energy of each candidate. The confidence score of the converged beat stream R is calculated by means of the equation:

$$R_{confidence} = \max\{R_F, R_1, \ldots, R_N\} \tag{3}$$

The basic principle of beat candidate selection is setting a proper threshold for the extracted FV. The local maxima found within a search window meeting certain conditions are selected as beat candidates. This process is performed in each band separately. There are three threshold-based methods for selecting beat candidates, each method using a different threshold value. As stated above, the first method uses the primitive feature vector (i.e., multi-band energy) directly, the second method uses an improved feature vector (i.e., using element-to-mean ratio), and the third method uses differential energy values.

The first method is based on the absolute value of the multi-band energy of beats and non-beats. A threshold is set based on the distribution of beat and non-beat for selecting beat candidates within the search window. This method is computationally simple but needs some knowledge of the feature in order to set a proper threshold. The method has three possible outputs in the search window: no candidate, one candidate, or multiple candidates. In the case where at least one candidate is found, a statistical model is preferably used to determine the reliability of each candidate as a beat.

The second method uses the primitive feature vector to calculate an element-to-mean ratio within the search window to form a new feature vector. That is, the ratio of each element (energy in each granule) to the mean value (average energy in the search window) is calculated to determine the element-to-mean ratio. The maximum EMR is subsequently compared with an EMR threshold. If the EMR is greater than the threshold, this local maximum is selected as a beat candidate. This method is preferable to the first method in most cases since the relative distance between the individual element and the mean is measured, and not the absolute values of the elements. Therefore, the EMR threshold can be set as a constant value. In comparison, the threshold in the first method needs to be adaptive so as to be responsive to the wide dynamic range in music signals.

The third method uses differential energy band values (e.g., $E_b(n+1)-E_b(n)$, see equation (6) below) to form a new feature vector. One differential energy value is obtained for each granule, and the value represents the energy difference between the primitive feature vector band values in consecutive granules. The differential energy method requires less calculation than does the EMR method described above and, accordingly, may be the preferable method when computational resources are at a premium.

MP3 uses four different window types: a long window, a long-to-short window (i.e., a 'start' window), a short window, and a short-to-long window (i.e., a 'stop' window). These windows are indexed as 0, 1, 2, and 3 respectively. The short window is used for coding transient signals. It has been found that, with respect to 'pop' music, short windows often coincide with beats and offbeats since these are the events to most frequently trigger window-switching. Moreover, most of the window-switching patterns observed in tests appear in the following order: long ⇒ long-to-short ⇒ short ⇒ short ⇒ short-to-long ⇒ long. Using window indexing, this window-switching pattern can be denoted as a sequence of 0-1-2-2-3-0, where '0' denotes a long window and '2' denotes a short window.

It should be noted that the window-switching pattern depends not only on the encoder implementation, but also on the applied bitrate. Therefore, window-switching alone is not a reliable cue for beat detection. Thus, for general purpose beat detection, an MDCT-based method alone would be sufficient and window switching would not be required. The window-switching method is more applicable to error-concealment procedures. Accordingly, the MDCT-based method is used as the baseline beat detector in the preferred embodiment, due to its reliability, and the beat information (i.e., position and inter-beat interval) is validated with the window-switching pattern, as provided in the flow diagram of FIG. 3, above.

If the window switching also indicates a beat, and if the position of the beat indicated by the window switching is displaced less than four MP3 granules (that is, 4×13 msec, or 52 msec) from the beat position indicated by the MDCT-based method, the window-switching method is given priority. Beat information is taken from that obtained by window-switching and the MDCT-based information is adjusted accordingly. The beat information from MDCT-based method is used exclusively only when window-switching is not used. In a sequence of 0-1-2-2-3-0, for example, the beat position is taken to be the second short window (i.e., the second index 2), because the maximum value is most likely to be on the granule of the second short window.

In the example provided above, a segment of four consecutive granules indexed as 1-2-2-3 can be partially corrupted in a communication channel. It would still be possible to detect the transient by having decoded at least the window type information (i.e., two bits) of one single granule in the segment of four consecutive granules, even if the main data has been totally corrupted. Accordingly, even audio packets partially-damaged due to channel error are not be discarded as the packets can still be utilized to improve quality of service (QoS) in applications such as streaming music. This illustrates the value of the window-type beat-detection process to the disclosed method of combining beat information from the two separate detection methods so as to validate a beat position.

Figure 6:
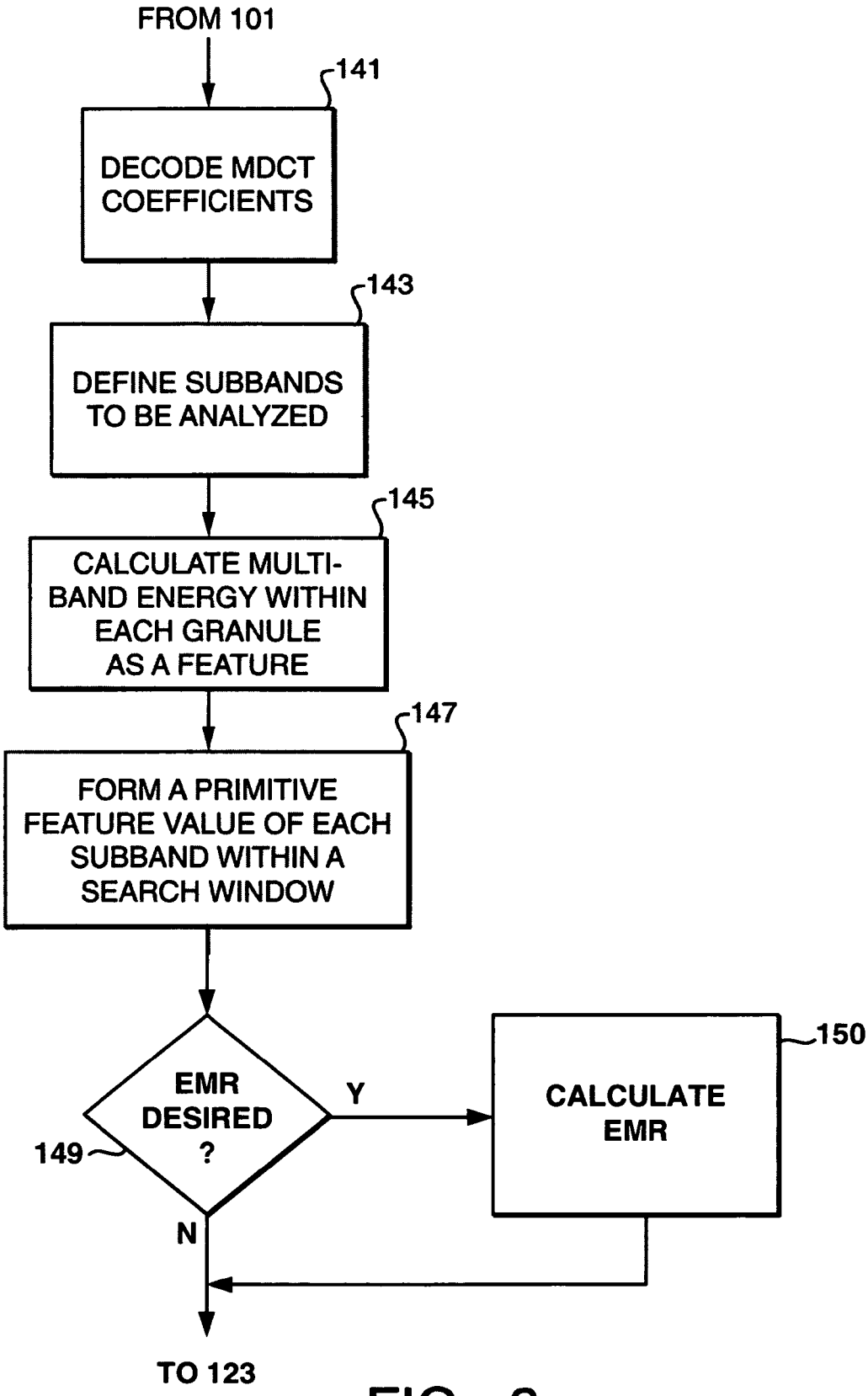
FIG. 6 is a flow diagram showing in greater detail a feature vector extraction procedure used in the flow diagram of FIG. 4.

FIG. 6 is a flow diagram showing in greater detail the process of performing feature vector extraction as in step 121 of FIG. 4, above. The MDCT coefficients in the MP3 audio bitstream 203 are decoded by the MDCT coefficient extractor 201, at step 141. The subbands to be used in the analysis are defined, at step 143. The feature vector calculation provides the multi-band energy within each granule as a feature, and then forms a feature vector of each band within a search window. The feature vector serves to effectively separate beats and non-beats.

The multi-band energy within each granule is thus defined as a feature, at step 145. This is used to form a primitive feature value of each subband within a search window, at step 147. The element-to-mean ratio can be used to improve the feature quality. If no EMR is desired, at decision block 149, operation proceeds to step 123, above. Otherwise, an EMR is calculated within the search window to form an EMR feature value, at step 150, before the operation proceeds to step 123.

The search window size determines the FV size, which is used for selecting beat candidates in individual bands. The search window size can be fixed or adaptive. For a fixed window size, a lower bound of 325 milliseconds is used as the search window size so that the maximal number of possible beats within the search window is one beat. A larger window size may enclose more than one beat. In a preferred embodiment, an adaptive window size is used because better performance can be obtained. The size of the adaptive window is determined by finding the closest odd integer to the median of the stored inter-onset intervals, so that a symmetric window is formed around a valid sample:

$$\text{window_size_new} = 2 \cdot floor\left(\frac{median(\overline{IOI})}{2}\right) + 1 \tag{4}$$

The hop size is selected to be half of the new search window size.

$$\text{hop_size_new} = round\left(\frac{\text{window_size_new}}{2}\right) \tag{5}$$

Figure 7:
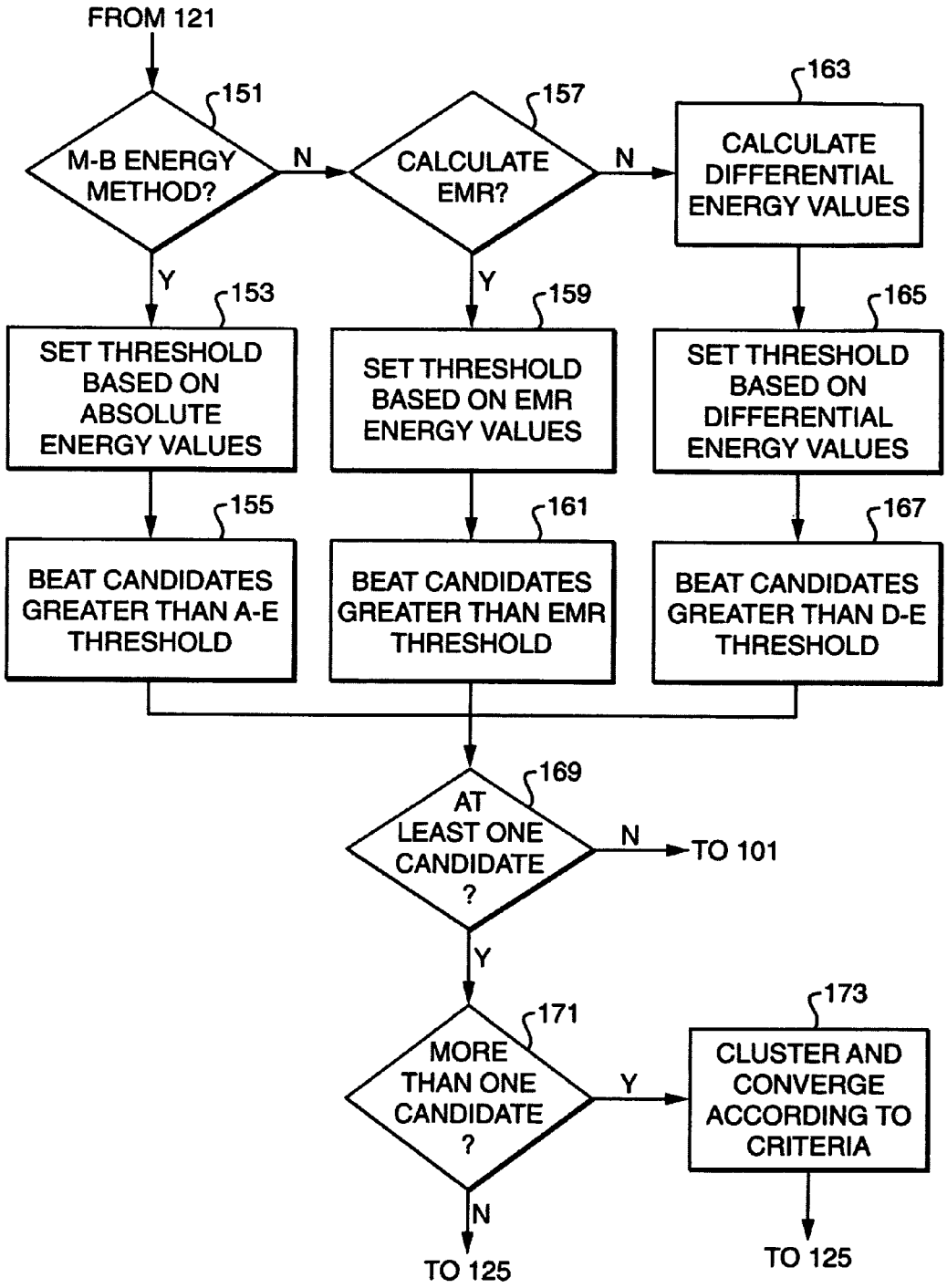
FIG. 7 is a flow diagram showing in greater detail a beat candidate determination procedure used in the flow diagram of FIG. 4.
Figure 8A:
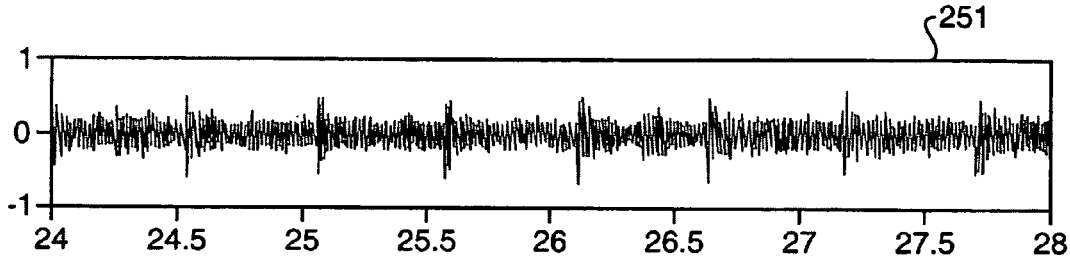
FIGS. 8A through 8H are illustrations of waveforms and subband energies derived in the procedure of FIG. 6.
Figure 8B:
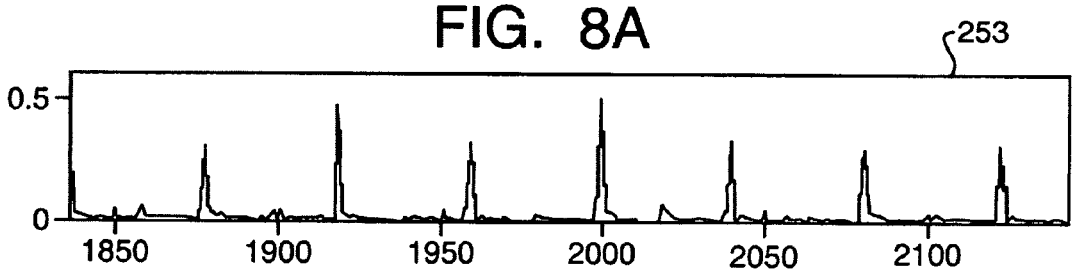
Figure 8C:
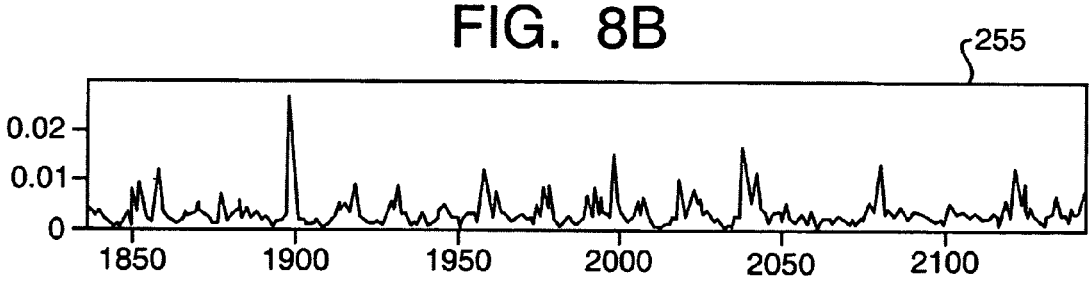
Figure 8D:
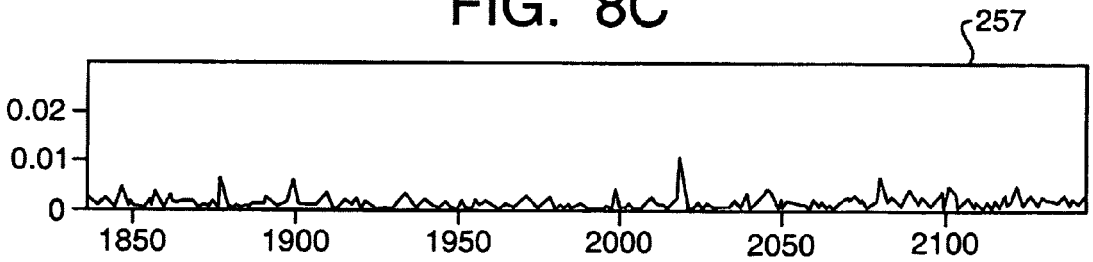
Figure 8E:
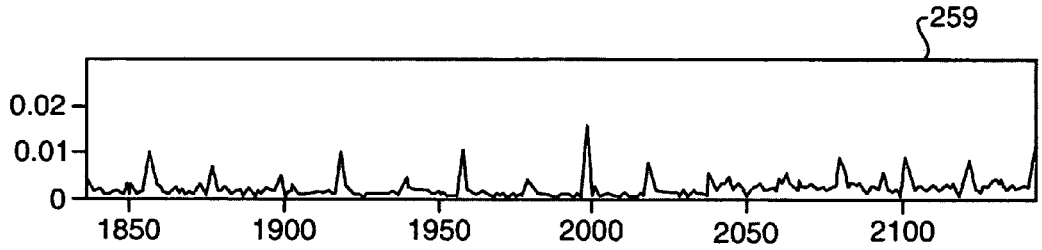
Figure 8F:
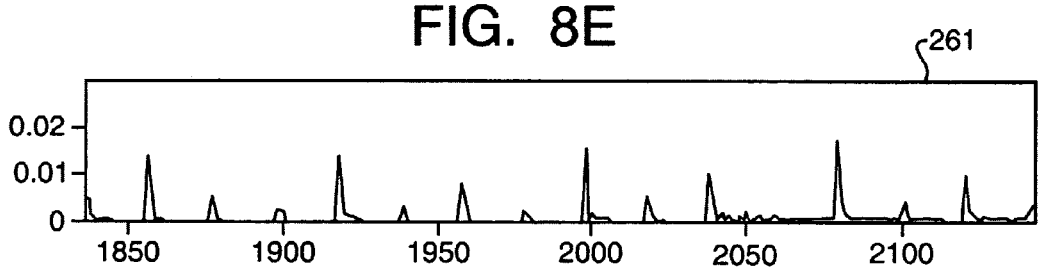
Figure 8G:
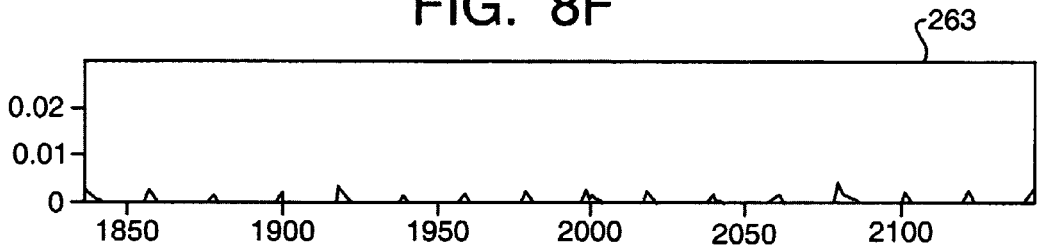
Figure 8H:
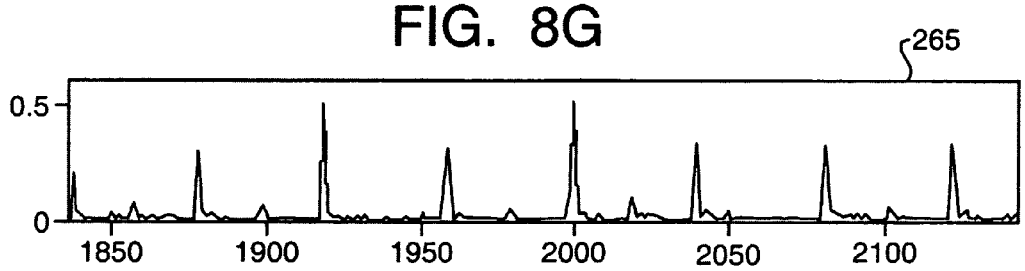

FIG. 7 is a flow diagram showing in greater detail the process of determining beat candidates as in step 123 in FIG. 4, above. A query is made at decision block 151 as to whether beat detection will be made using multi-band energy within each granule. If the response is 'yes,' a threshold is set based on absolute energy values, at step 153. Beat candidates are determined to be at locations where the absolute energy threshold is exceeded, at step 155. Operation then proceeds to decision block 169.

If the response at decision block 151 is 'no,' a query is made at decision block 157 as to whether beat detection will be made using element-to-mean ratio within each granule. If the response is 'yes,' a threshold is set based on EMR values, at step 159. Beat candidates are determined to be at locations where the element-to-mean ratio energy threshold is exceeded, at step 161, and operation proceeds to decision block 169.

If the response at decision block 157 is 'no,' differential energy values are calculated, at step 163, and a threshold is set based on differential energy values, at step 165. Beat candidates are determined to be at locations where the differential energy threshold is exceeded, at step 167, and operation proceeds to decision block 169.

If there is not at least one candidate, at decision block 169, no beat has been found and operation proceeds to step 101 where the next data is obtained by hopping. If there is more than one beat candidate, at decision block 171, the two or more candidates are clustered and converged, at step 173, and operation returns to step 125. If there is only one beat candidate, at decision block 171, operation proceeds directly to step 125.

FIGS. 8A through 8H are examples of waveforms and subband energies as derived in the process of FIG. 7. Feature vectors are extracted in multiple bands and then processed separately. Graph 251 (FIG. 8A) shows a music waveform of approximately four seconds in duration. Graphs 253–263 (FIGS. 8B–8G) represent the energy distributions in each of the six subbands used in the preferred embodiment. Graph 265 (FIG. 8H) represents the full-band energy distribution.

MP3 methodology includes the use of long windows and short windows. The long window length is specified to include thirty-six subband samples, and the short window length is specified to include twelve subband samples. A 50% window overlap is used in the MDCT. In the disclosed method, the MDCT coefficients of each granule are grouped into six newly-defined subbands, as provided in Tables I and II, above. The grouping in Tables I and II has been derived in consideration of the constraint of the MPEG standard and in view of the need to reduce system complexity. The feature extraction grouping also produces a more consistent frequency resolution for both long and short windows. In alternative embodiments, similar frequency divisions can be specified for other codecs or configurations.

Each band provides a value by summation of the energy within a granule. Thus, the time resolution of the disclosed method is one MP3 granule, or thirteen milliseconds for a sampling rate of 44.1 kHz, in comparison to a theoretical beat event, which has a duration of zero. The energy $E_b(n)$ of band b in granule n is calculated directly by summing the squares of the decoded MDCT coefficients to give:

$$E_b(n) = \sum_{j=N1}^{N2} [X_j(n)]^2 \tag{6}$$

where $X_j(n)$ is the $j^{th}$ normalized MDCT coefficient decoded at granule n, N1 is the lower bound index, and N2 is the higher bound index of MDCT coefficients defined in Tables I and II. Since the feature extraction is performed at the granule level, the energy in three short windows (which are equal in duration to one long window) is combined to give comparable energy levels for both long and short windows.

The disclosed method utilizes primarily the subbands 1, 5, and 6, and the full band to extract the respective feature vectors for applications such as pop music beat tracking. It can be appreciated by one skilled in the relevant art that the subbands 2, 3 and 4 typically provide poor feature values as the sound energy from singing and from instruments other than drums are concentrated mostly in these subbands. As a consequence, it becomes more difficult to distinguish beats and non-beats in the subbands 2, 3, and 4.

An error concealment method is usually invoked to mitigate audio quality degradation resulting from the loss of compressed audio packets in error-prone channels, such as mobile Internet and digital audio broadcasts. A conventional error concealment method may include muting, interpolation, or simply repeating a short segment immediately preceding the lost segment. These methods are useful if the lost segment is short, less than approximately 20 milliseconds or so, and the audio signal is fairly stationary. However, for lost segments of greater duration, or for non-stationary audio signals, a conventional method does not usually produce satisfactory results.

The disclosed system and method make use of the beat-pattern similarity of music signals to conceal a possible burst-packet loss in a best-effort based network such as the Internet. The burst-packet loss error concealment method results from the observations that a music signal typically exhibits rhythm and beat characteristics, where the beat-patterns of most music, particularly pop music, march, and dance music, are fairly stable and repetitive. The time signature of pop music is typically 4/4, the average inter-beat interval is about 500 milliseconds, and the duration of a bar is about two seconds.

Figure 9:
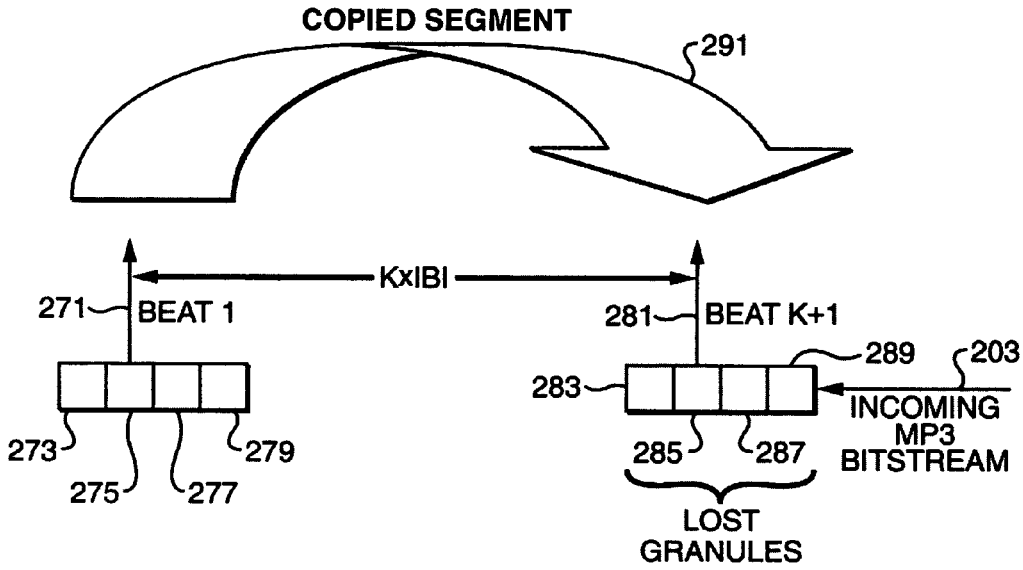
FIG. 9 is a diagrammatical illustration of an error concealment method using a beat detection method such as exemplified by FIG. 3.

FIG. 9 is a diagrammatical illustration of an error concealment procedure which can benefit from application of the beat-detection method described in the flow diagram of FIG. 4. A first group of four small segments 273–279 grouped about a first beat 271 represent MP3 granules. A second group of four small segments 283–289 grouped about a subsequent beat 281 represent MP3 granules that have been lost in transmission or in processing. As understood in the relevant art, an MP3 frame comprises two granules, where each granule includes 576 frequency components. It has been observed that a segment located adjacent to a beat, such as may correspond to a transient produced by a rhythmic instrument such as a drum, is subjectively more similar to a prior segment located adjacent a previous beat than to its immediate neighboring segment. Thus, in the example provided, the first group of segments 273–279 can be substituted with the first beat 271 for the second, missing group of segments 283–289 and the missing beat 281, as represented by a replacement arrow 291, without creating an undesirable audio discontinuity in the audio bitstream 203.

A possible psychological verification of this assumption may be provided as follows. If we observe typical pop music with a drum sound marking the beat in a 3-D time-frequency representation, the drum sound usually appears as a ridge, short in the time domain and broad in the frequency domain. In addition, the drum sound usually masks other sounds produced by other instruments or by voice. The drum sound is usually dominant in pop music, so much so that one may perceive only the drum sound to the exclusion of other musical sounds. It is usually subjectively more pleasant to replace a missing drum sound with a previous drum sound segment rather than with another sound, such as singing. This may be valid in spite of variations in consecutive drum sounds. It becomes evident from this observation that the beat detector control block 45 plays a crucial role in an error-concealment method. Moreover, it is reasonable to perform the beat detection directly in the compressed domains to avoid execution of redundant operations.

As can be appreciated by one skilled in the relevant art, the requirement of such a beat detector depends on the constraint on computational complexity and memory consumption available in the terminal device employing the beat detection. In the disclosed method, the beat detector control block 45 utilizes the window types and the MDCT coefficients decoded from the MP3 audio bitstream 203 to perform beat tracking. Three parameters are output: the beat position, the inter-beat interval, and the confidence score.

Moreover, the window shapes in all MDCT based audio codecs, including the MPEG-2/4 advance audio coding (AAC), need to satisfy certain conditions to achieve time domain alias cancellation (TDAC). In addition, TDAC also implies that the duration of an audio bitstream is infinite, which is not a valid assumption in the case of packet loss, for example. In such cases, the time domain aliases will not be able to cancel each other during the overlap-add (OA) operation, and audible distortion will likely result.

By way of example, if the two consecutive short window granules indexed as 2-2 in a window-switching sequence of 0-1-2-2-3-0 are lost in a transmission channel, it is straightforward to deduce their window types from their neighboring granules. A previous short window granule pair can replace the lost granules so as to mitigate the subjective degradation. However, if the window-switching information available from the audio bitstream is disregarded and the short window is replaced with any other neighboring window types, producing a window-switching pattern such as 0-1-1-1-3-0, the TDAC conditions will be violated and result in annoying artifacts.

Figure 11:
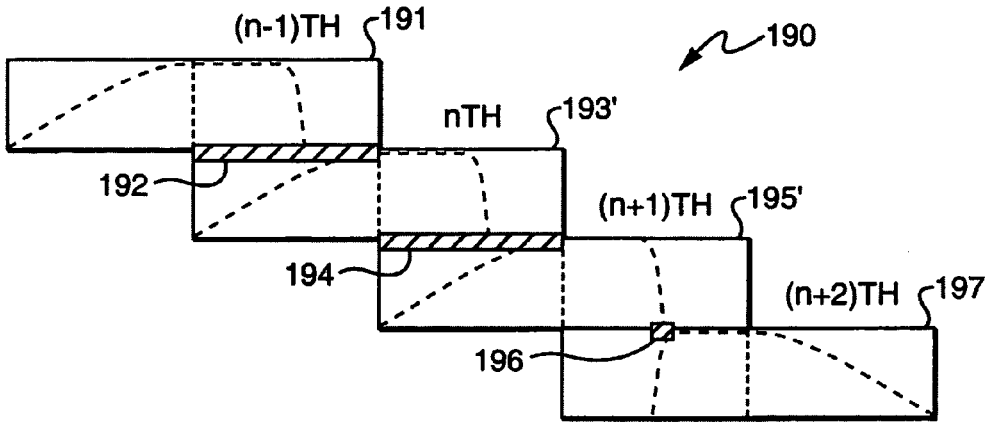
FIG. 11 is an example of a conventional error concealment method.

This problem, and the solution provided by the disclosed method, can be explained with reference to FIGS. 10 and 11 in which an $n^{th}$ granule 183 (not shown) and an $(n+1)^{th}$ granule 185 (not shown) have been lost in a four-granule sequence 180. The two missing granules 183 and 185 are identified by their positions relative to an adjacent beat, such as may have occurred at the position of the $(n+1)^{th}$ granule 185. Accordingly, the two missing granules 183 and 185 are replaced by replacement granules 183' and 185', respectively, as shown. The replacement granules 183' and 185' have the same relationship to a previous beat that the missing granules 183 and 185 had to the local beat at (n+1), for example. Since the replacement granules 183' and 185' are not exactly equivalent to the lost granules 183 and 185, there may be some inaudible alias distortion in overlap regions 182 and 186 due to properties of the MDCT function. However, the window functions, indicated by dashed line 177 for example, enable a fade-in and a fade-out in the overlap-add operation, making any introduced alias essentially imperceptible.

In comparison, conventional granule replacement does not take into account beat location. In FIG. 11, for example, two missing granules 193 and 195 (not shown) have been replaced by replacement granules 193' and 195', respectively, as shown. However, the replacement granules 193 ' and 195' are copies of the $(n-1)^{th}$ granule 181, which has a long-to-short window. As can be seen, the replacement granules 93' and 195' should have short windows, instead, to provide a smooth transition between the long-to-short window $(n-1)^{th}$ granule 191 and the short-to-long window $(n+2)^{th}$ granule 197. Accordingly, audible audio distortion will occur in overlap regions 192, 194, and 196 due to the window-type mismatch. It can be appreciated by one skilled in the relevant art that a '0' can be followed either by another '0' or by a '1,' and that a '2' can be followed either by another '2' or by a '3.' However, a '1' must be followed by a '2' and a '3' must be followed by a '0' to avoid distortion effects.

Figure 12:
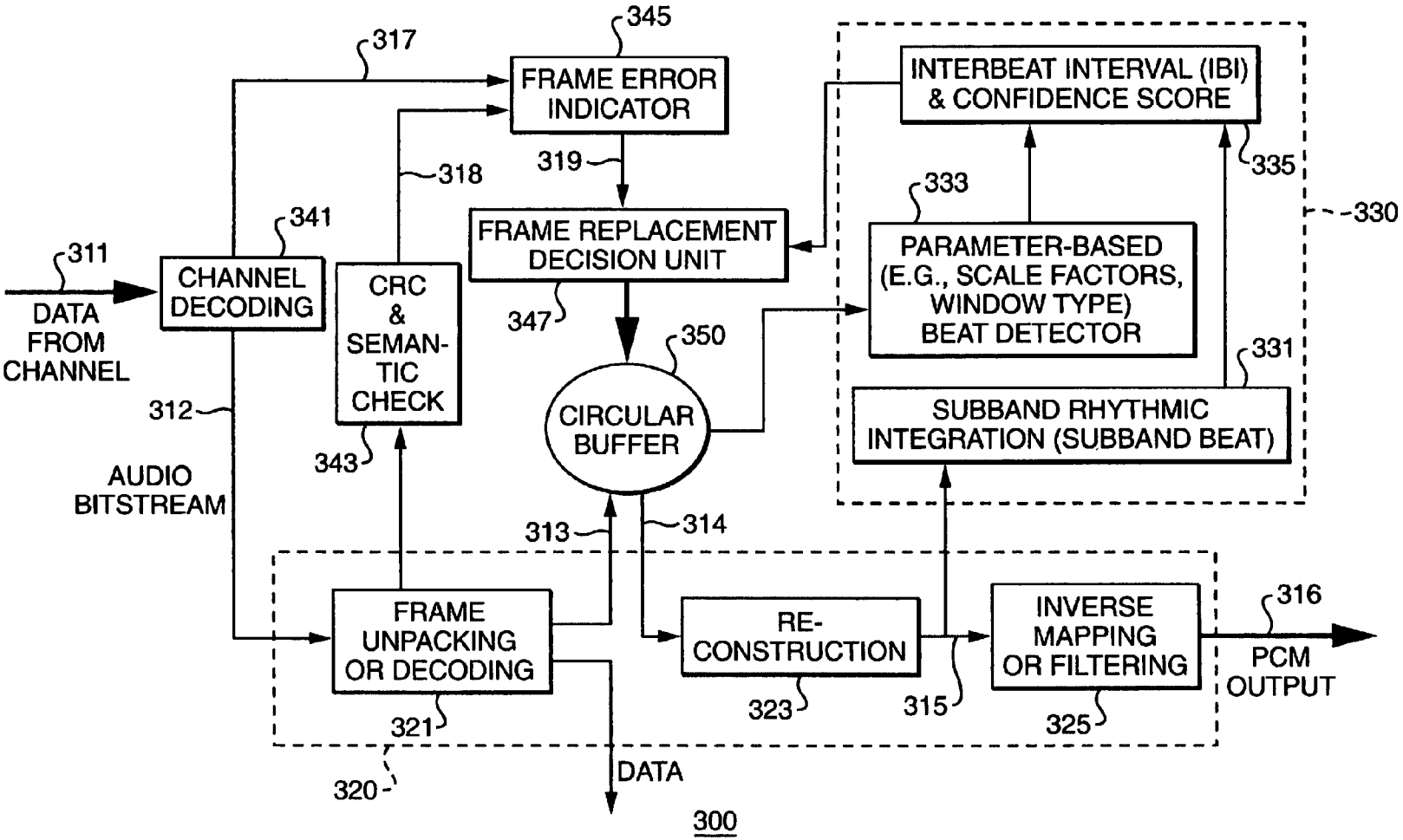
FIG. 12 is a basic block diagram of an audio decoder including a beat detector and a circular FIFO buffer.

There is shown in FIG. 12 an audio decoder system 300 suitable for use in the receiver section 41 of the mobile phone 11 shown in FIG. 2, for example. The audio decoder system 300 includes an audio decoder section 320 and a compressed-domain beat detector 330 operating on compressed audio data 311, such as may be encoded per ISO/IEC 11172-3 and 13818-3 Layer I, Layer II, or Layer III standards. A channel decoder 341 decodes the audio data 311 and outputs an audio bitstream 312 to the audio decoder section 320.

The audio bitstream 312 is input to a frame decoder 321 where frame decoding (i.e., frame unpacking) is performed to recover an audio information data signal 313. The audio information data signal 313 is sent to the circular FIFO buffer 350, and a buffer output data signal 314 is returned. The buffer output data signal 314 is provided to a reconstruction section 323 which outputs a reconstructed audio data signal 315 to an inverse mapping section 325. The inverse mapping section 325 converts the reconstructed audio data signal 315 into a pulse code modulation (PCM) output signal 316.

If an audio data error is detected by the channel decoder 341, a data error signal 317 is sent to a frame error indicator 345. When a bitstream error found in the frame decoder 321 is detected by a CRC checker 343, a bitstream error signal 318 is sent to the frame error indicator 345. The audio decoder system 300 functions to conceal these errors so as to mitigate possible degradation of audio quality in the PCM output signal 316.

Error information 319 is provided by the frame error indicator 345 to a frame replacement decision unit 347. The frame replacement decision unit 347 functions in conjunction with the beat detector 330 to replace corrupted or missing audio frames with one or more error-free audio frames provided to the reconstruction section 323 from the circular FIFO buffer 350. The beat detector 330 identifies and locates the presence of beats in the audio data using a variance beat detector section 331 and a window-type detector section 333, corresponding to the feature vector analyzers 211–219 and the window-type beat detector 205 in FIG. 5 above. The outputs from the variance beat detector section 331 and from the window-type detector section 333 are provided to an inter-beat interval detector 335 which outputs a signal to the frame replacement decision unit 347.

Figure 13:
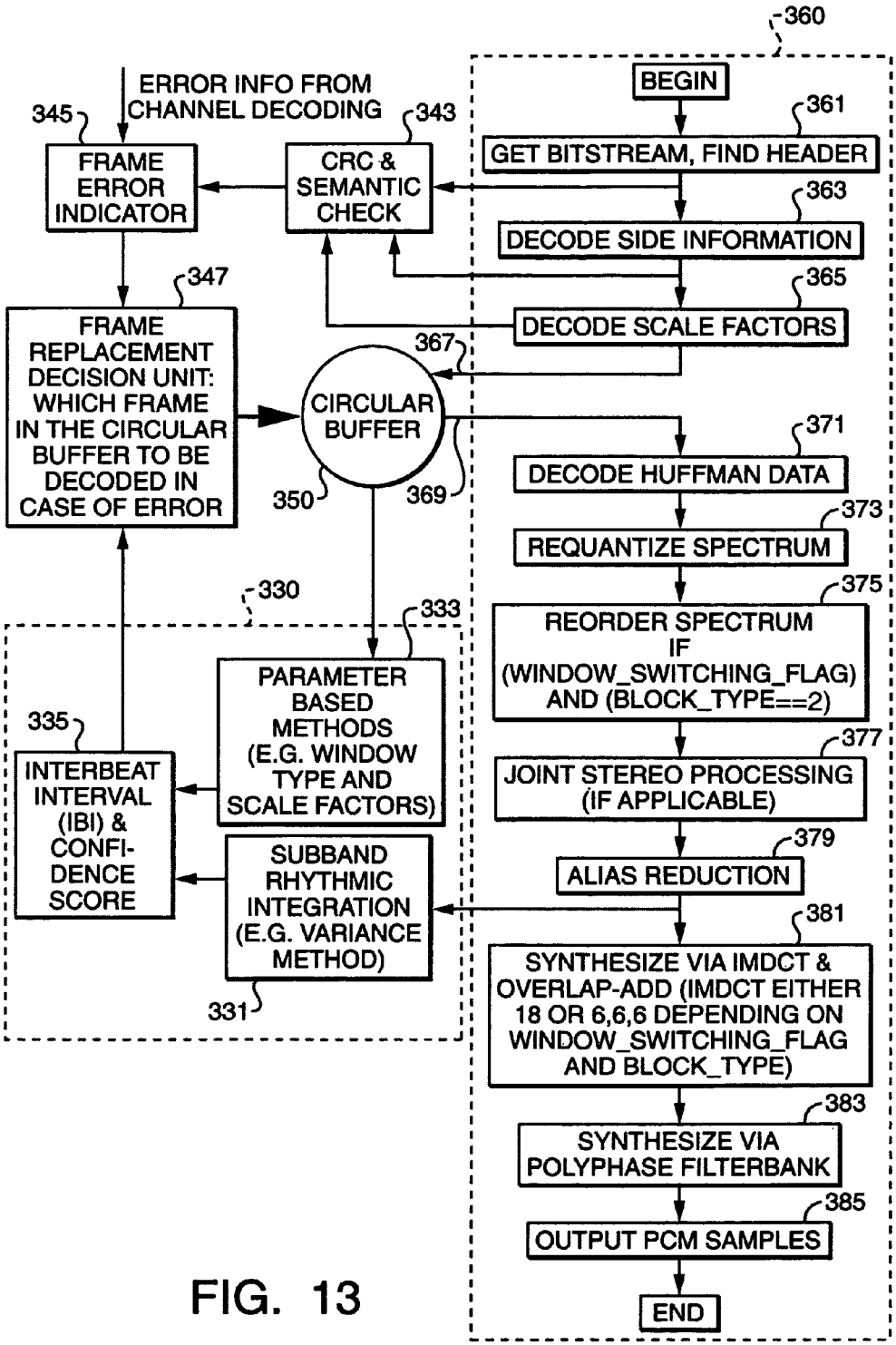
FIG. 13 is a flowchart of the operations performed by the decoder system of FIG. 10 when applied to an MP3 audio data stream.

This process of error concealment can be explained with additional reference to the flow diagram 360 of FIG. 13. For purpose of illustration, the operation of the audio decoder system 300 is described using MP3-encoded audio data but it can be appreciated by one skilled in the relevant art that the disclosed method is not limited to MP3 coding applications. With minor modification, the disclosed method can be applied to other audio transmission protocols. In the flow diagram 360, the frame decoder 321 receives the audio bitstream 312 and reads the header information (i.e., the first thirty two bits) of the current audio frame, at step 361. Information providing sampling frequency is used to select a scale factor band table. The side information is extracted from the audio bitstream 312, at step 363, and stored for use during the decoding of the associated audio frame. Table select information is obtained to select the appropriate Huffman decoder table. The scale factors are decoded, at step 365, and provided to the CRC checker 343 along with the header information read in step 361 and the side information extracted in step 363.

As the audio bitstream 312 is being unpacked, the audio information data signal 313 is provided to the circular FIFO buffer 350, at step 367, and the buffer output data 314 is returned to the reconstruction section 323, at step 369. As explained below, the buffer output data 314 includes the original, error-free audio frames unpacked by the frame decoder 321 and replacement frames for the frames which have been identified as missing or corrupted. The buffer output data 314 is subjected to Huffman decoding, at step 371, and the decoded data spectrum is requantized using a 4/3 power law, at step 373, and reordered into sub-band order, at step 375. If applicable, joint stereo processing is performed, at step 377. Alias reduction is performed, at step 379, to preprocess the frequency lines before being inputted to a synthesis filter bank. Following alias reduction, the reconstructed audio data signal 315 is sent to the inverse mapping section 325 and also provided to the variance detector 331 in the beat detector 330.

In the inverse mapping section 325, the reconstructed audio data signal 315 is blockwise overlapped and transformed via an inverse modified discrete cosine transform (IMDCT), at step 381, and then processed by a polyphase filter bank, at step 383, as is well-known in the relevant art. The processed result is outputted from the audio decoder section 320 as the PCM output signal 316, at step 385.

The above is a description of the realization of the invention and its embodiments utilizing examples. It should be self-evident to a person skilled in the relevant art that the invention is not limited to the details of the above presented examples, and that the invention can also be realized in other embodiments without deviating from the characteristics of the invention. Thus, the possibilities to realize and use the invention are limited only by the claims, and by the equivalent embodiments which are included in the scope of the invention.

What is claimed is:

1. A method for detecting beats in a compression encoded audio bitstream, said method comprising the steps of:

(a) determining a baseline beat position using modified discrete cosine transform (MDCT) coefficients obtained from the audio bitstream;

(b) deriving from the audio bitstream a window-switching pattern for sub-band sampling windows used to generate the MDCT coefficients;

(c) determining a window-switching beat position based on the derived window-switching pattern;

(d) comparing said baseline beat position with said window-switching beat position; and (e) validating said window-switching beat position as a detected beat if a predetermined condition is satisfied.

2. A method as in claim 1 further comprising the step of determining an inter-beat interval related to said baseline beat position.

3. A method as in claim 2 further comprising the step of storing said window-switching beat position and said inter-beat interval for subsequent retrieval.

4. A method as in claim 1 wherein said step of determining a baseline beat position comprises the step of determining at least one beat candidate and an inter-onset interval.

5. A method as in claim 4 wherein said step of determining a baseline beat position further comprises the step of checking said at least one beat candidate for reliability using a predetermined confidence threshold value.

6. A method as in claim 4 further comprising the step of converging two or more said beat candidates to a single beat candidate.

7. A method as in claim 1 wherein said step of deriving baseline beat information from the audio bitstream comprises the step of deriving an energy value for at least one subband from the compression encoded audio bitstream.

8. A method as in claim 7 wherein said subband comprises a member of the group consisting of a frequency interval from 0 to 459 Hz, a frequency interval from 460 to 918 Hz, a frequency interval from 919 to 1337 Hz, a frequency interval from 1.338 to 3.404 kHz, a frequency interval from 3.405 to 7.462 kHz, and a frequency interval from 7.463 to 22.05 kHz.

9. A method as in claim 7 wherein said step of deriving a beat position comprises the step of identifying a maximum energy value within a search window.

10. A method as in claim 7 wherein said step of deriving an energy value for at least one subband comprises the step of deriving an absolute energy value.

11. A method as in claim 7 wherein said step of deriving an energy value for at least one subband comprises the step of deriving an element-to-mean energy value.

12. A method as in claim 7 wherein said step of deriving an energy value for at least one subband comprises the step of deriving a differential energy value.

13. The method of claim 1, wherein step (a) comprises determining a baseline beat position prior to inverse modified discrete cosine transform (IMDCT) processing of the MDCT coefficients.

14. The method of claim 1, wherein the predetermined condition of step (e) comprises relative displacement of the window-switching and baseline beat positions by less than a predetermined amount.

15. The method of claim 1, wherein step (a) further comprises:

i) obtaining the MDCT coefficients from a portion of the audio bitstream within a search window, ii) sorting the MDCT coefficients into a plurality of subband divisions, iii) identifying beat candidates within some or all of the subband divisions, iv) calculating a confidence score for beat candidates identified in step iii), v) calculating a converged confidence score from the confidence scores of step iv), and vi) determining the baseline beat position within the search window based on the converged confidence score.

16. The method of claim 15, wherein step iii) includes identifying a full band beat candidate across all of the subband divisions.

17. The method of claim 16, wherein step iv) includes calculating a confidence score using the following formula:

$$R_i = \max_{k=1,2,3}\left[\frac{\text{median}(\overline{IOI})}{\text{median}(\overline{IOI}) + \left|\text{median}(\overline{IOI}) - \frac{(I_i - I_{\text{last_beat}})}{k}\right|}\right] * f(E_i),$$

wherein i is equal to F, 1, . . . , N, where 1 through N are indices of subband divisions and F is the index for the full band, $R_i$ is equal to the confidence score for index i, $\overline{IOI}$ is a vector of intervals between previous beat candidates within the subband divisions, k is set to 1 unless the current interval between beat candidates within a subband division is two or three times longer than a predicted value because of a missed candidate, and set to 2 or 3 otherwise, $I_i$ is a granule index of a current beat candidate, $I_{last_beat}$ is a granule index of a previous beat, and $f(E_i)$ equals 0 if the energy (E) of a candidate for index i is less than a threshold, and is 1 if the energy (E) of that candidate is greater than the threshold.

18. The method of claim 17, wherein step v) includes calculating a converged confidence score using the following formula:

$$R_{confidence} = \max\{R_F, R_b, \ldots, R_N\}.$$

19. The method of claim 15, wherein the search window size is adaptive.

20. The method of claim 19, wherein the search window is sized according to the formula $$\text{window_size_new} = 2 * \text{floor}\left(\frac{\text{median}(\overline{IOI})}{2}\right) + 1,$$

wherein window_size_new is a new size of the search window, and $\overline{IOI}$ is a vector of intervals between previous beat candidates within the subband divisions.

21. The method of claim 15, wherein step iii) comprises identifying a feature value, within a subband division and during the search window, exceeding a threshold.

22. The method of claim 21, wherein identifying a feature value comprises determining whether a primitive band energy E within a subband division exceeds a threshold value, and wherein the primitive band energy E is calculated according to the formula $$E_b(n) = \sum_{j=N1}^{N2} [X_j(n)]^2,$$

wherein $E_b(n)$ is the energy of subband b in granule n, $X_j(n)$ is the $j^{th}$ normalized MDCT coefficient decoded at granule n, N1 is a lower bound index of the MDCT coefficients sorted into subband b, and N2 is an upper bound index of the MDCT coefficients sorted into subband b.

23. The method of claim 21, wherein identifying a feature value further comprises:

(1) determining the energy in a granule, (2) determining the average energy in the search window, (3) determining the ratio of the quantity determined in step (1) to the quantity determined in step (2).

24. The method of claim 21, wherein identifying a feature value further comprises computing a differential energy value for subband divisions using the formula $E_b(n+1)-E_b(n)$, wherein $$E_b(n) = \sum_{j=N1}^{N2} [X_j(n)]^2,$$

$E_b(n)$ is the energy of subband b in granule n of the audio bitstream, $X_j(n)$ is the $j^{th}$ normalized MDCT coefficient decoded at granule n, N1 is a lower bound index of the MDCT coefficients sorted into subband b, N2 is an upper bound index of the MDCT coefficients sorted into subband b, $$E_b(n+1) = \sum_{j=N1}^{N2} [X_j(n+1)]^2,$$

$E_b(n+1)$ is the energy of subband b in granule n+1 of the audio bitstream, $X_j(n+1)$ is the $j^{th}$ normalized MDCT coefficient decoded at granule n+1, N1 is a lower bound index of the MDCT coefficients sorted into subband b, and N2 is an upper bound index of the MDCT coefficients sorted into subband b.

25. The method of claim 1, wherein the audio bitstream is an MP3 encoded audio bitstream, and wherein step (b) comprises determining a pattern of long, long-to-short, short and short-to-long windows in the audio bitstream.

26. A beat detector suitable for placement into an audio device conforming to a compression-encoded audio transmission protocol, said beat detector comprising:

a modified discrete cosine transform coefficient extractor, for obtaining transform coefficients from an audio bitstream;

at least one band feature value analyzer for analyzing a feature value for a related band, the at least one band feature value analyzer receiving input from the modified discrete cosine transform coefficient extractor;

a confidence score calculator receiving input from the at least one band feature value analyzer, the confidence score calculator calculating a confidence score for beat candidates using stored values of previous inter-onset intervals; and a converging and storage unit for combining two or more of said beat candidates.

27. The beat detector as in claim 26 wherein said feature value comprises a member of the group consisting of an absolute energy value, an element-to-mean energy value, and a differential energy value.

28. The beat detector as in claim 27 further comprising an element-to-mean ratio threshold comparator.

29. An audio encoder suitable for use with a compression-encoded audio transmission protocol, said audio encoder comprising:

a beat detector including a modified discrete cosine transform coefficient extractor, for obtaining transform coefficients;

at least one band feature value analyzer for analyzing a feature value for a related band;

a confidence score calculator; and means for including beat detection information as side information in audio transmission.

30. An audio decoder suitable for use with a compression-encoded audio transmission protocol, said audio decoder comprising:

a beat detector for providing beat position information, said beat detector including a modified discrete cosine transform coefficient extractor, for obtaining transform coefficients;

at least one band feature value analyzer for analyzing a feature value for a related band;

a confidence score calculator; and error concealment means for concealing packet loss in audio transmission by utilizing said beat position to identify audio data for replacement of packet loss.

31. An audio encoder, comprising:

a beat detector, said beat detector being configured to perform a method for detecting beats in a compression encoded audio bitstream, said method including the steps of (a) determining a baseline beat position using modified discrete cosine transform (MDCT) coefficients obtained from the audio bitstream, (b) deriving from the audio bitstream a window-switching pattern for sub-band sampling windows used to generate the MDCT coefficients, (c) determining a window-switching beat position based on the derived window-switching pattern, (d) comparing the baseline beat position with the window-switching beat position, and (e) validating the window-switching beat position as a detected beat if a predetermined condition is satisfied.

32. The audio encoder of claim 31, wherein step (a) comprises determining a baseline beat position prior to inverse modified discrete cosine transform (IMDCT) processing of the MDCT coefficients.

33. The audio encoder of claim 31, wherein the predetermined condition of step (e) comprises relative displacement of the window-switching and baseline beat positions by less than a predetermined amount.

34. The audio encoder of claim 31, wherein step (a) further comprises:

i) obtaining the MDCT coefficients from a portion of the audio bitstream within a search window, ii) sorting the MDCT coefficients into a plurality of subband divisions, iii) identifying beat candidates within some or all of the subband divisions, iv) calculating a confidence score for beat candidates identified in step iii), v) calculating a converged confidence score from the confidence scores of step iv), and vi) determining the baseline beat position within the search window based on the converged confidence score.

35. The audio encoder of claim 34, wherein step iii) includes identifying a full band beat candidate across all of the subband divisions.

36. The audio encoder of claim 35, wherein step iv) includes calculating a confidence score using the following formula:

$$R_i = \max_{k=1,2,3}\left[\frac{\text{median}(\overline{IOI})}{\text{median}(\overline{IOI}) + \left|\text{median}(\overline{IOI}) - \frac{(I_i - I_{\text{last_beat}})}{k}\right|}\right] * f(E_i),$$

wherein i is equal to F, 1, . . . , N, where 1 through N are indices of subband divisions and F is the index for the full band, $R_i$ is equal to the confidence score for index i, $\overline{IOI}$ is a vector of intervals between previous beat candidates within the subband divisions, k is set to 1 unless the current interval between beat candidates within a subband division is two or three times longer than a predicted value because of a missed candidate, and set to 2 or 3 otherwise, $I_i$ is a granule index of a current beat candidate, $I_{last_beat}$ is a granule index of a previous beat, and $f(E_i)$ equals 0 if the energy (E) of a candidate for index i is less than a threshold, and is 1 if the energy (E) of that candidate is greater than the threshold.

37. The audio encoder of claim 36, wherein step v) includes calculating a converged confidence score using the following formula:

$$R_{confidence} = \max\{R_F, R_1, \ldots, R_N\}.$$

38. The audio encoder of claim 34, wherein the search window size is adaptive.

39. The audio encoder of claim 38, wherein the search window is sized according to the formula $$\text{window_size_new} = 2 * \text{floor}\left(\frac{\text{median}(\overline{IOI})}{2}\right) + 1,$$

wherein window_size_new is a new size of the search window, and $\overline{IOI}$ is a vector of intervals between previous beat candidates within the subband divisions.

40. The audio encoder of claim 34, wherein step iii) comprises identifying a feature value, within a subband division and during the search window, exceeding a threshold.

41. The audio encoder of claim 40, wherein identifying a feature value comprises determining whether a primitive band energy E within a subband division exceeds a threshold value, and wherein the primitive band energy E is calculated according to the formula $$E_b(n) = \sum_{j=N1}^{N2} [X_j(n)]^2,$$

wherein $E_b(n)$ is the energy of subband b in granule n, $X_j(n)$ is the $j^{th}$ normalized MDCT coefficient decoded at granule n, N1 is a lower bound index of the MDCT coefficients sorted into subband b, and N2 is an upper bound index of the MDCT coefficients sorted into subband b.

42. The audio decoder of claim 40, wherein identifying a feature value further comprises:

(1) determining the energy in a granule, (2) determining the average energy in the search window, (3) determining the ratio of the quantity determined in step (1) to the quantity determined in step (2).

43. The audio decoder of claim 40, wherein identifying a feature value further comprises computing a differential energy value for subband divisions using the formula $E_b(n+1)-E_b(n)$, wherein $$E_b(n) = \sum_{j=N1}^{N2} [X_j(n)]^2,$$

$E_b(n)$ is the energy of subband b in granule n of the audio bitstream, $X_j(n)$ is the $j^{th}$ normalized MDCT coefficient decoded at granule n, N1 is a lower bound index of the MDCT coefficients sorted into subband b, N2 is an upper bound index of the MDCT coefficients sorted into subband b, $$E_b(n+1) = \sum_{j=N1}^{N2} [X_j(n+1)]^2,$$

$E_b(n+1)$ is the energy of subband b in granule n+1 of the audio bitstream, $X_j(n+1)$ is the $j^{th}$ normalized MDCT coefficient decoded at granule n+1, N1 is a lower bound index of the MDCT coefficients sorted into subband b, and N2 is an upper bound index of the MDCT coefficients sorted into subband b.

44. The audio decoder of claim 31, wherein the audio bitstream is an MP3 encoded audio bitstream, and wherein step (b) comprises determining a pattern of long, long-to-short, short and short-to-long windows in the audio bitstream.

45. An audio decoder, comprising:

a beat detector, said beat detector being configured to perform a method for detecting beats in a compression encoded audio bitstream, said method including the steps of (a) determining a baseline beat position using modified discrete cosine transform (MDCT) coefficients obtained from the audio bitstream, (b) deriving from the audio bitstream a window-switching pattern for sub-band sampling windows used to generate the MDCT coefficients, (c) determining a window-switching beat position based on the derived window-switching pattern, (d) comparing the baseline beat position with the window-switching beat position, and (e) validating the window-switching beat position as a detected beat if a predetermined condition is satisfied.

46. The audio decoder of claim 45, wherein step (a) comprises determining a baseline beat position prior to inverse modified discrete cosine transform (IMDCT) processing of the MDCT coefficients.

47. The audio decoder of claim 45, wherein the predetermined condition of step (e) comprises relative displacement of the window-switching and baseline beat positions by less than a predetermined amount.

48. The audio decoder of claim 45, wherein step (a) further comprises:

i) obtaining the MDCT coefficients from a portion of the audio bitstream within a search window, ii) sorting the MDCT coefficients into a plurality of subband divisions, iii) identifying beat candidates within some or all of the subband divisions, iv) calculating a confidence score for beat candidates identified in step iii), v) calculating a converged confidence score from the confidence scores of step iv), and vi) determining the baseline beat position within the search window based on the converged confidence score.

49. The audio decoder of claim 48, wherein step iii) includes identifying a full band beat candidate across all of the subband divisions.

50. The audio decoder of claim 49, wherein step iv) includes calculating a confidence score using the following formula:

$$R_i = \max_{k=1,2,3}\left[\frac{\text{median}(\overline{IOI})}{\text{median}(\overline{IOI}) + \left|\text{median}(\overline{IOI}) - \frac{(I_i - I_{\text{last_beat}})}{k}\right|}\right] * f(E_i),$$

wherein i is equal to F, 1, . . . , N, where 1 through N are indices of subband divisions and F is the index for the full band, $R_i$ is equal to the confidence score for index i, $\overline{IOI}$ is a vector of intervals between previous beat candidates within the subband divisions, k is set to 1 unless the current interval between beat candidates within a subband division is two or three times longer than a predicted value because of a missed candidate, and set to 2 or 3 otherwise, $I_i$ is a granule index of a current beat candidate, $I_{last_bit}$ is a granule index of a previous beat, and $f(E_i)$ equals 0 if the energy (E) of a candidate for index i is less than a threshold, and is 1 if the energy (E) of that candidate is greater than the threshold.

51. The audio decoder of claim 50, wherein step v) includes calculating a converged confidence score using the following formula:

$$R_{confidence} = \max\{R_F, R_1, \ldots, R_N\}.$$

52. The audio decoder of claim 48, wherein the search window size is adaptive.

53. The audio decoder of claim 52, wherein the search window is sized according to the formula $$\text{window_size_new} = 2 * \text{floor}\left(\frac{\text{median}(\overline{IOI})}{2}\right) + 1,$$

wherein window_size_new is a new size of the search window, and $\overline{IOI}$ is a vector of intervals between previous beat candidates within the subband divisions.

54. The audio decoder of claim 48, wherein step iii) comprises identifying a feature value, within a subband division and during the search window, exceeding a threshold.

55. The audio decoder of claim 54, wherein identifying a feature value comprises determining whether a primitive band energy E within a subband division exceeds a threshold value, and wherein the primitive band energy E is calculated according to the formula $$E_b(n) = \sum_{j=N1}^{N2} [X_j(n)]^2,$$

wherein $E_b(n)$ is the energy of subband b in granule n, $X_j(n)$ is the $j^{th}$ normalized MDCT coefficient decoded at granule n, N1 is a lower bound index of the MDCT coefficients sorted into subband b, and N2 is an upper bound index of the MDCT coefficients sorted into subband b.

56. The audio decoder of claim 54, wherein identifying a feature value further comprises:

(1) determining the energy in a granule, (2) determining the average energy in the search window, (3) determining the ratio of the quantity determined in step (1) to the quantity determined in step (2).

57. The audio decoder of claim 54, wherein identifying a feature value further comprises computing a differential energy value for subband divisions using the formula $E_b(n+1)-E_b(n)$, wherein $$E_b(n) = \sum_{j=N1}^{N2} [X_j(n)]^2,$$

$E_b(n)$ is the energy of subband b in granule n of the audio bitstream, $X_j(n)$ is the $j^{th}$ normalized MDCT coefficient decoded at granule n, N1 is a lower bound index of the MDCT coefficients sorted into subband b, N2 is an upper bound index of the MDCT coefficients sorted into subband b, $$E_b(n+1) = \sum_{j=N1}^{N2} [X_j(n+1)]^2,$$

$E_b(n+1)$ is the energy of subband b in granule n+1 of the audio bitstream, $X_j(n+1)$ is the $j^{th}$ normalized MDCT coefficient decoded at granule n+1, N1 is a lower bound index of the MDCT coefficients sorted into subband b, and N2 is an upper bound index of the MDCT coefficients sorted into subband b.

58. The audio decoder of claim 45, wherein the audio bitstream is an MP3 encoded audio bitstream, and wherein step (b) comprises determining a pattern of long, long-to-short, short and short-to-long windows in the audio bitstream.

* * * * *